US008834293B2

(12) United States Patent
Thomas et al.

(10) Patent No.: US 8,834,293 B2
(45) **Date of Patent: *Sep. 16, 2014**

(54) GOLF CLUBS AND GOLF CLUB HEADS INCLUDING STRUCTURE TO SELECTIVELY CONTROL THE SOUND OF THE CLUB HEAD

(71) Applicant: Nike, Inc., Beaverton, OR (US)

(72) Inventors: James S. Thomas, Fort Worth, TX (US); Tyrone Northcutt, Granbury, TX (US)

(73) Assignee: Nike, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/016,907

(22) Filed: Sep. 3, 2013

(65) Prior Publication Data

US 2014/0004972 A1 Jan. 2, 2014

Related U.S. Application Data

(63) Continuation of application No. 12/721,879, filed on Mar. 11, 2010, now Pat. No. 8,523,702.

(51) Int. Cl.

| | |
|---|---|
| ***A63B 59/00*** | (2006.01) |
| ***A63B 53/06*** | (2006.01) |
| *A63B 53/04* | (2006.01) |

(52) U.S. Cl.

CPC ..... *A63B 53/06* (2013.01); *A63B 59/0092* (2013.01); *A63B 2053/0433* (2013.01); *A63B 53/0466* (2013.01)

USPC ..... 473/332; 473/345; 473/338

(58) Field of Classification Search

USPC ..... 473/332, 338, 345

See application file for complete search history.

(56) References Cited

U.S. PATENT DOCUMENTS

| | | | | |
|---|---|---|---|---|
| 4,775,156 | A * | 10/1988 | Thompson | 473/328 |
| 6,524,197 | B2 * | 2/2003 | Boone | 473/324 |
| 7,445,563 | B1 * | 11/2008 | Werner | 473/332 |

* cited by examiner

*Primary Examiner* — Michael Dennis

(74) *Attorney, Agent, or Firm* — Banner & Witcoff, Ltd.

(57) ABSTRACT

The invention relates generally to golf clubs and golf club heads that enable users, club fitters, club manufacturers, and the like to selectively control, change, and customize aspects of the "sound" associated with the golf club and golf club head when it strikes a golf ball. Golf clubs and golf club heads according to this invention may include: a) a club head body; b) a ball striking face engaged with or integrally formed as part of the club head body; c) a hosel member engaged with or integrally formed as at least a portion of the club head; and d) means for changing a sound emanated by the club head when a golf ball contacts the ball striking face. A user may change the vibrational characteristics associated with the club head when a golf ball is struck, thereby changing the sound emanating from the club head when a golf ball is struck.

25 Claims, 18 Drawing Sheets

GOLF CLUBS AND GOLF CLUB HEADS INCLUDING STRUCTURE TO SELECTIVELY CONTROL THE SOUND OF THE CLUB HEAD

This application is a continuation of U.S. patent application Ser. No. 12/721,879, filed Mar. 11, 2010 which is entirely incorporated herein by reference.

FIELD OF THE INVENTION

The invention relates generally to golf clubs and golf club heads that enable users, club fitters, club manufacturers, and the like to selectively control, change, and customize aspects of the "sound" associated with the golf club and golf club head when it strikes a golf ball.

BACKGROUND

Golf is enjoyed by a wide variety of players—players of different genders, and players of dramatically different ages and skill levels. Golf is somewhat unique in the sporting world in that such diverse collections of players can play together in golf events, even in direct competition with one another (e.g., using handicapped scoring, different tee boxes, etc.), and still enjoy the golf outing or competition. These factors, together with increased golf programming on television (e.g., golf tournaments, golf news, golf history, and/or other golf programming) and the rise of well known golf superstars, at least in part, have increased golf's popularity in recent years both in the United States and across the world.

Golfers of all skill levels seek to improve their performance, lower their golf scores, and reach that next performance "level." Manufacturers of all types of golf equipment have responded to these demands, and recent years have seen dramatic changes and improvements in golf equipment. For example, a wide range of different golf ball models now are available, with some balls designed to fly farther and straighter, provide higher or flatter trajectory, provide more spin, control, and feel (particularly around the greens), etc.

Being the sole instruments that set a golf ball in motion during play, golf clubs also have been the subject of much technological research and advancement in recent years. For example, the market has seen improvements in golf club heads, shafts, and grips in recent years. Additionally, other technological advancements have been made in an effort to better match the various elements of the golf club and characteristics of a golf ball to a particular user's swing features or characteristics (e.g., club fitting technology, ball launch angle measurement technology, etc.).

Golfers tend to be sensitive to the "feel" of a golf club. The "feel" of a golf club comprises the combination of various component parts of the club and various features associated with the club that produce the sensory sensations experienced by the player when a ball is swung at and/or struck. Club weight, weight distribution, aerodynamics, swing speed, and the like all may affect the "feel" of the club as it swings and strikes a ball. "Feel" also has been found to be related to the sound produced when a club head strikes a ball to send the ball in motion. If a club head makes an unpleasant, undesirable, or surprising sound at impact, a user may flinch, give up on his/her swing, or decelerate the swing, thereby affecting distance, direction, and/or other performance aspects of the swing and the resulting ball motion. User anticipation of this unpleasant, undesirable, or surprising sound can affect a swing even before the ball is hit.

Every golfer's tastes and preferences with respect to "feel" aspects of a golf club differ. In other words, providing an acceptable golf club "feel" is not a "one size fits all" proposition. Accordingly, it would be advantageous to provide golf club heads and/or golf clubs, including wood-type golf club heads and/or clubs, that enable users to change, control, and customize various aspects of the club's "feel" to match their particular preference, liking, and/or swing characteristics. In some instances, it would be particularly advantageous to provide golf club heads and/or golf clubs, including wood-type golf club heads and/or clubs, that enable users to change, control, and customize the sound emanating from the club head when a ball is struck to suit their particular taste, liking, and/or swing characteristics.

SUMMARY

The following presents a general summary of aspects of the invention in order to provide a basic understanding of at least some of its aspects. This summary is not intended as an extensive overview of the invention. It is not intended to identify key or critical elements of the invention or to delineate the scope of the invention. The following summary merely presents some concepts of the invention in a general form as a prelude to the more detailed description provided below.

Aspects of this invention relate to golf clubs and golf club heads that include: (a) a club head body; (b) a ball striking face engaged with or integrally formed as part of the club head body; and (c) a hosel member engaged with or integrally formed with at least a portion of the club head. The club head body includes a crown portion and a sole portion. The sole portion includes a borehole insert that extends into the club head body. The club head body further includes a post that engages the borehole insert, optionally in a slidable manner. The post has a first end and a second end opposite the first end, wherein when the post slides into the club head body, the first end is inserted into the borehole insert and the second end of the post is substantially flush with or countersunk in the sole portion. Additionally the post may include external threads and the borehole insert may include internal threads. The post external threads may engage the borehole insert internal threads when the post is inserted into the club head body. Additionally, in accordance with this invention, a variety of features of the club head, specifically the post, may be varied to alter a sound emanating from the club head body when a golf ball contacts the ball striking face. For example, the length of the post may be selectively varied to alter a sound emanating from the club head body when a golf ball contacts the ball striking face. As another example, a cross-sectional shape of the post may be selectively varied to alter a sound emanating from the club head body when a golf ball contacts the ball striking face. The post may have, for example, a round, rectangular, triangular, or flat cross-section. As yet another example, the material of the post may be selectively varied to alter a sound emanating from the club head body when a golf ball contacts the ball striking face. Additionally or alternatively, if desired, the post may include a weight located along the post, wherein the location of the weight along the post may be selectively varied to alter a sound emanating from the club head body when a golf ball contacts the ball striking face. The weight may include internal threads, wherein the weight threadably engages the post to move from the first end to the second end of the post. The post may be hollow, solid, partially hollowed out along its longitudinal length, etc. As yet additional examples, the tightening force of the post (or the force it applies to the crown portion and/or the sole portion of the club head body) may be selectively varied to alter the sound produced by the club head when a ball is struck.

Additional aspects of this invention relate to golf clubs and golf club heads that include: (a) a club head body; (b) a ball striking face engaged with or integrally formed as part of the club head body; (c) a hosel member engaged with or integrally formed with at least a portion of the club head; and (d) means for changing a sound emanated by the club head when a golf ball contacts the ball striking face. The means for changing the sound may allow a user to selectively change the sound emanated by the club head when the golf ball contacts the ball striking face. The sound emanated by the club head may be changed, for example, in any of the various ways described above. In at least some structures according to this aspect of the invention, at least a portion of the means for changing the sound may be engaged or integrally formed with the club head and/or at least a portion of the means for changing the sound may be removable from the club head.

Still additional aspects of the invention relate to methods for making golf clubs or golf club heads in accordance with examples of the invention. For example, methods according to at least some examples of this invention may include: (a) providing a club head including a borehole through the sole portion that opens into the club head; and (b) engaging a borehole insert with the borehole or engaging a means for changing the sound emanated by the club head with the club head. The post and/or means for changing the sound may have any of the features or characteristics described above. Additionally, the method may include the steps of (c) engaging a golf club shaft with the club head at the hosel member; and/or (d) engaging a grip member with the golf club shaft.

Still additional aspects of the invention relate to methods for using golf clubs or golf club heads to control the sound and/or other aspects of the feel associated with a golf club or golf club head when it contacts a golf ball in use. For example, methods according to at least some examples of this invention may include the steps of: (a) providing a golf club of the types described above; and (b) adjusting the means for changing a sound to thereby change the sound emanated by the club head when the golf ball contacts the ball striking face. The sound emanated by the club head may be changed in any one or more of the various manners described above.

BRIEF DESCRIPTION OF THE DRAWINGS

A more complete understanding of the present invention and certain advantages thereof may be acquired by referring to the following description in consideration with the accompanying drawings, in which like reference numbers indicate like features, and wherein.

Figure 1:
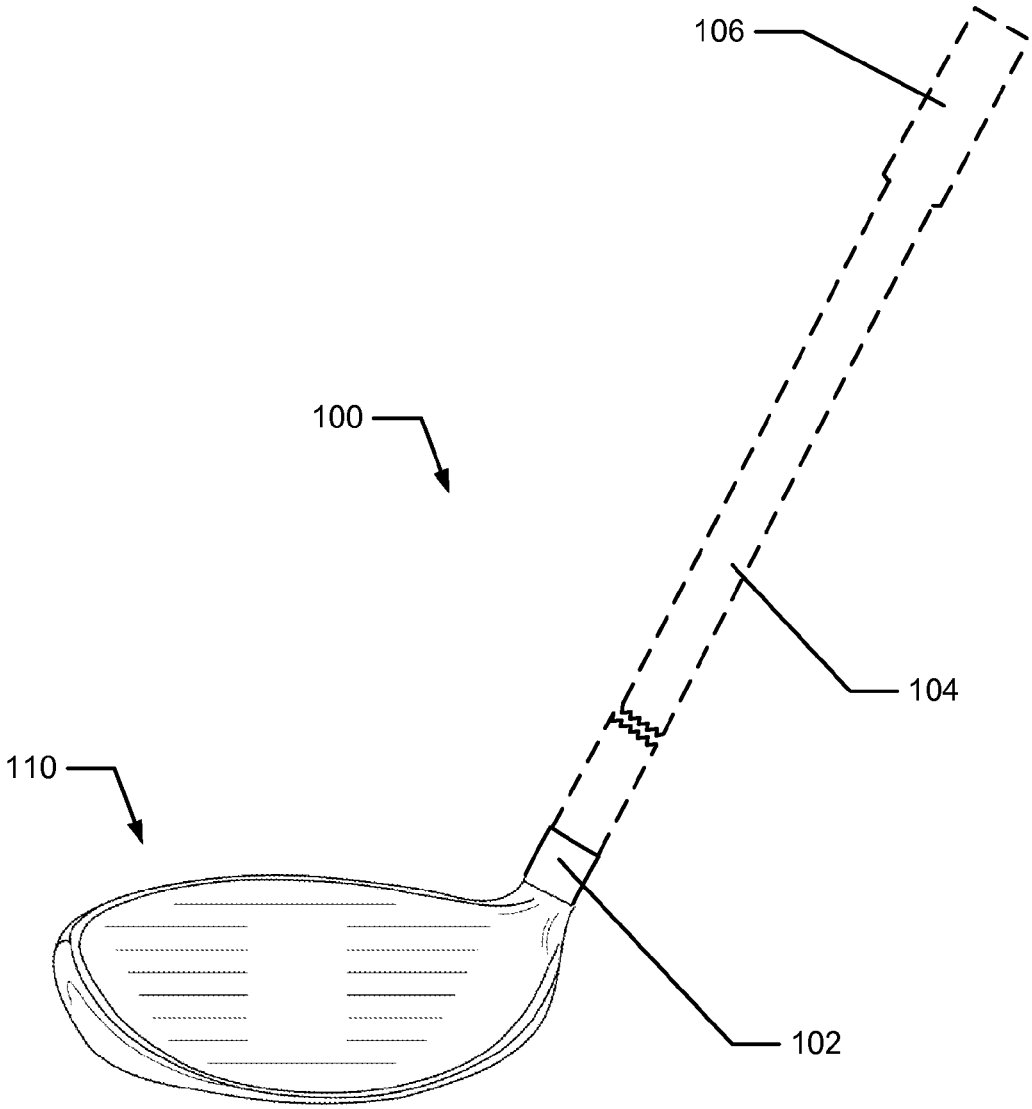
FIG. 1 illustrates a front view of an example golf club according to this invention.

The reader is advised that the attached drawings are not necessarily drawn to scale.

DETAILED DESCRIPTION

In the following description of various example embodiments of the invention, reference is made to the accompanying drawings, which form a part hereof, and in which are shown by way of illustration various example structures, devices, systems, and environments in which aspects of the invention may be practiced. It is to be understood that other specific arrangements of parts, structures, example devices, systems, and environments may be utilized and structural and functional modifications may be made without departing from the scope of the present invention. Also, while the terms "top," "bottom," "front," "back," "side," and the like may be used in this specification to describe various example features and elements of the invention, these terms are used herein as a matter of convenience, e.g., based on the example orientations shown in the figures. Nothing in this specification should be construed as requiring a specific three dimensional orientation of structures in order to fall within the scope of this invention.

To assist the reader, this specification is broken into various subsections, as follows: General Description of Golf Clubs and Golf Club Heads According to Aspects of the Invention; Specific Examples of the Invention; and Conclusion.

A. General Description of Golf Clubs and Golf Club Heads According to Aspects of the Invention In general, aspects of this invention relate to golf clubs and golf club heads. Such golf clubs and golf club heads, according to at least some examples of the invention, may include: (a) a club head body; (b) a ball striking face engaged with or integrally formed as part of the club head body; and (c) a hosel member engaged with or integrally formed with at least a portion of the club head. The club head body includes a crown portion and a sole portion. As used herein, the term "hosel member" includes any structure for receiving a golf club shaft and engaging it with a golf club head, whether the connection is permanent or releasable, internal and/or external to the club head body, etc.

Additionally, the golf club and golf club heads in accordance with this invention may include a means for changing the sound that emanates from the club head body when a golf ball contacts the ball striking face. The means for changing the sound may include, for example, a borehole insert and a post. A borehole through the club head sole may open into the club head body, the borehole insert may engage the borehole, and the post may engage the borehole insert, e.g., in a slidable manner. Additionally, in accordance with this invention, a variety of features of the club head, such as features regarding the construction, structure, orientation, and/or forces applied to the club head by the post, may be varied to alter a sound emanating from the club head body when a golf ball contacts the ball striking face.

The golf club head body may take on a variety of forms without departing from this invention. For example, the club head body may be made from any desired number of different parts, of any desired construction, from any desired materials, etc., without departing from this invention, including from conventional parts, of conventional constructions, and/or from conventional materials as are known and used in the art. In some example structures, the club head body will be a wood-type golf club head and will include one or more of the following parts: a crown portion, a sole portion with a ground-engaging surface, a face member (optionally including a ball striking face integrally formed therein or attached thereto), a cup face, one or more body ribbons (e.g., forming or defining the periphery of the club head between the crown and sole portions), a sole plate, a frame member (optionally of metal, such as titanium alloys or the like, e.g., forming or defining the periphery of the club head between the crown and sole portions and/or to which one or more of the crown portion and/or the sole portion (if present) are engaged, etc.), an aft body, etc.

The means for changing the sound may function in various ways without departing from the invention. For example, in some golf club heads, the length of the post may be selectively varied to alter a sound emanating from the club head body when a golf ball contacts the ball striking face. In another example in accordance with this invention, a cross-sectional size and/or shape of the post may be selectively varied (e.g., by exchanging one post for another, by adding one or more layers of material to the post (such as a layer of tape, etc.), by removing one or more layers of material from the post, etc.) to alter a sound emanating from the club head body when a golf ball contacts the ball striking face. The post may have a round, rectangular, triangular, flat, or any other desired cross-section without departing from the invention (and the cross-sectional shape may change over the longitudinal length of the post). As another example in accordance with this invention, the material of the post may be selectively varied to alter a sound emanating from the club head body when a golf ball contacts the ball striking face. As yet another example in accordance with this invention, the post may include a weight located along the post, wherein the location of the weight along the post may be selectively varied to alter a sound emanating from the club head body when a golf ball contacts the ball striking face. The weight may include internal threads, wherein the weight threadably engages the post to move from the first end to the second end of the post. As still additional examples, various types of materials may be attached to the post, such as a rubber end cap or other end cap material, to alter the sound features of the club head. Furthermore, in some structures, the force applied by the post to the crown and/or sole portions may be selectively changed (e.g., by tightening or loosening a threaded connection by which the post is engaged with the club head body, by changing a length of the post located within the club head interior, by changing the force applied by a spring, etc.) to alter the sound characteristics of the club head.

If desired, at least some or even all of the club head body and/or the ball striking face of the club head may be made from titanium metal and/or titanium based alloy materials. In some more specific examples, at least 50% of the mass, volume, and/or surface area of the club head body and/or the entire club head will be made from titanium metal and/or titanium based alloy materials, and in some example structures, these amounts may be at least 75%, at least 85%, at least 90%, or even at least 95%.

Golf clubs in accordance with examples of this invention may include additional features. For example, in an aspect of this invention, the sole may be configured to confront and engage the playing surface in use. With clubs that are configured to hit a ball resting directly on the playing surface, such as a fairway wood, the sole may contact the playing surface in use, and features of the club may be designed accordingly. For such clubs, the head of the post and/or the bottom (exposed) surface of the borehole insert may extend into a countersunk portion of the sole so that the head of the post or the bottom surface of the borehole insert is flush with and/or recessed into the main surface of the sole. The exterior surface of the post head and/or the bottom of the borehole insert may be curved to smoothly match the main surface of the sole. As another example, if desired, the head of the post and/or the bottom surface of the borehole insert may covered by a cover member that may have the post head and/or bottom borehole insert characteristics described above. The sole may comprise a ground-engaging surface that includes a keel positioned along a center of the sole and extending rearward from a bottom edge of the face toward a rear of the head opposite the face. The keel may be configured to be a lowest surface of the head in use, and at least a portion of the keel may be raised with respect to adjacent surfaces. Additionally, the keel may have a substantially smooth curvilinear surface. In another example, the keel may have a plurality of substantially smooth, substantially planar surfaces oriented at transverse angles to each other.

Golf clubs in accordance with examples of this invention may include additional features, if desired, including features that are known and used in the golf club art. For example, a weighting system may be permanently mounted to the club head body member, e.g., on an interior or exterior of the club head body, extending from the exterior to the interior of the club head body (e.g., through a weight port), etc. As yet additional examples, if desired, the weighting system may include one or more weight member(s) that are movably and/or removably mounted with respect to the club head body member, e.g., using structures and techniques that are known and used in the art (e.g., by screw, set screw, or other mechanical connector attachments, by sliding attachments, etc.). Advantageously, in accordance with at least some examples of this invention, the weighting system will include weight members located at or proximate to a rear of the club head body member, optionally with weight members provided toward the rear toe, the rear heel, and/or the rear sole portions of the club head. If desired, at least some portions of the weighting system may be selectively movable and/or removable from the club head body member and/or mountable in a variety of different positions and/or arrangements, e.g., to allow customization, interchange, replacement, and/or club-fitting (e.g., to provide a draw biased club, to provide a fade biased club, to provide a high trajectory biased club, to provide a low trajectory biased club, to provide a club to help compensate for undesired ball flights or swing flaws (e.g., to help correct hooks, slices, etc., to help get balls airborne, to help prevent ballooning ball flights, etc.), etc.).

Various features of the club head body part(s) may help reduce or "save" additional weight to enable selective positioning of discretionary weight in the club head structure to increase the club head's moment of inertia and/or otherwise alter its characteristics. For example, the crown portion and/or the sole portion of the club head may include a central area and a perimeter area, wherein the central area is made thinner than the perimeter area (e.g., by chemical milling, by molding or otherwise shaping it in this manner, etc.). Likewise, the ball striking face may be thinned around its perimeter (to thereby provide the variable thickness ball striking face). The mass "saved" due to the reduced thickness areas of the crown portion, sole portion, and/or ball striking face portion then may be "repositioned" in the club head structure to increase the moment of inertia of the club head, to affect ball flight characteristics (e.g., to bias the club for certain desired types of ball flights, as mentioned above), and/or to help compensate for user swing flaws.

Golf clubs in accordance with examples of this invention may include still additional features, if desired, including features that are known and used in the golf club art. For example, the golf clubs may include systems and methods for connecting golf club heads to shafts in a releasable manner so that the club heads and shafts can be readily interchanged and/or so that the angle and/or position of the shaft with respect to the club head body (and its ball striking face) can be readily changed. The club head and shaft may be interchanged with respect to one another by releasing the securing system and interchanging the originally present parts (e.g., shafts, club heads, etc.) with different parts having different characteristics. In such structures, the shaft can be quickly and easily exchanged for a different shaft on the club head body (e.g., a shaft of different length, different flex characteristics, different material, different mass, etc.). Additionally or alternatively, if desired, in such structures, the club head can be quickly and easily exchanged for a different one on the shaft (e.g., a club head of different loft, lie angle, size, brand, etc.). Additionally or alternatively, the shaft may be angled and/or the chamber for receiving the shaft in a shaft engaging member may be angled with respect to the axial direction of the club head hosel or club head engaging member so as to allow adjustment of the angle or position of the shaft with respect to the club head (e.g., with respect to its ball striking face) by rotating the shaft engaging member with respect to the club head body.

Additionally, the releasable connection assemblies may be used in any desired manner without departing from the invention. The golf clubs with such connection assemblies may be designed for use by the golfer in play (and optionally, if desired, the golfer may freely change shafts, heads, and/or their positioning with respect to one another). As another example, if desired, golf clubs including releasable connections in accordance with the invention may be used as club fitting tools and when the desired combination of head, shaft, and positioning have been determined for a specific golfer, a club builder may use the determined information to then produce a final desired golf club product using conventional (and permanent) mounting techniques (e.g., cements or adhesives). Other variations in the club/shaft connection assembly parts and processes are possible without departing from this invention.

Still additional aspects of the invention relate to methods for making golf clubs or golf club heads in accordance with examples of the invention. For example, methods according to at least some examples of this invention may include: (a) providing a club head including a borehole that extends through the club head sole portion and opens into the club head interior; (b) engaging a borehole insert with the club head at the borehole; and (c) engaging a post with the borehole insert, e.g., in a slidable and/or threaded manner, such that a portion of the post extends into the club head interior. The club head, borehole insert, and/or post may have any of the various features and/or characteristics described above. Additionally, the method may include the steps of (c) engaging a golf club shaft with the club head at the hosel member; and/or (d) engaging a grip member with the golf club shaft.

Still additional aspects of the invention relate to methods for using features of golf clubs and golf club heads to control the sound and/or other aspects of the feel associated with a golf club and golf club head when it contacts a golf ball in use. For example, methods according to at least some examples of this invention may include the steps of: (a) providing a golf club that includes a borehole in the sole portion that extends through the sole portion and opens into the club head interior; (b) engaging a means for changing a sound emanating by the club head when a golf ball contacts the ball striking face with the club head (e.g., at the borehole in the sole portion); and (c) adjusting the means for changing a sound to thereby change the sound emanated by the club head when the golf ball contacts the ball striking face. The means for changing the sound may allow a user to selectively change the sound emanated by the club head when the golf ball contacts the ball striking face, e.g., in any one or more of the various manners described above.

The various parts of the golf club and the club head may be engaged together in any desired manner. As some more specific examples, the various "engaging" steps described above may include one or more of: bonding using adhesives or cements; engaging using welding, brazing, soldering, or other fusing techniques; attachment using mechanical connectors including user releasable connectors (such as screws, bolts, nuts, or the like); and the like.

Specific examples of the invention are described in more detail below. The reader should understand that these specific examples are set forth merely to illustrate examples of the invention, and they should not be construed as limiting the invention.

B. Specific Examples of the Invention

The various figures in this application illustrate examples of golf clubs and golf club heads and components thereof useful as examples of this invention and useful in methods according to examples of this invention. When the same reference number appears in more than one drawing, that reference number is used consistently in this specification and the drawings to refer to the same or similar parts throughout.

FIG. 1 generally illustrates an example golf club 100 in accordance with at least some examples of this invention. As is conventional, the golf club 100 includes a club head 110, a hosel member 102 that connects the club head 110 to a shaft 104, and a grip member 106 engaged with the shaft 104. Various example features and aspects of the club head structure 110 will be described in more detail below in conjunction with the remaining figures. The club head 110 may be engaged with the shaft 104 via the hosel 102 in any desired manner, including in manners that are known and used in the art (e.g., via cements or adhesives, via mechanical connectors, via releasable mechanical connections, via welding, soldering, brazing, or other fusing techniques, etc.). Any desired material may be used for the shaft member 104, including conventional materials that are known and used in the art, such as steel, graphite, polymers, composite materials, combinations of these materials, etc. Likewise, the grip member 106 may be engaged with the shaft 104 in any desired manner, including in manners that are known and used in the art (e.g., via cements or adhesives, via mechanical connections, via releasable mechanical connections, etc.). Any desired material may be used for the grip member 106, including conventional materials that are known and used in the art, such as rubber, polymeric materials, cork, rubber or polymeric materials with cord or other fabric elements embedded therein, cloth or fabric, tape, etc.

The golf clubs 100 shown in FIGS. 1A through 16 contain many common features, which are referenced by similar reference numerals in the description below. The club head 110 may include a club head body 112 and a ball striking face 114. The club head body 112 generally has a top or crown 116 and a bottom or sole 118.

The golf club head body 112 may take on a variety of shapes and forms without departing from this invention. For example, the club head body 112 may be made from any desired number of different parts, or any desired construction, from any desired materials, etc., without departing from this invention, including from conventional parts, of conventional constructions, and/or from conventional materials as are known and used in the art. The club head body 112 may include: one or more metal alloy parts (e.g., a frame, optionally including or engaged with the ball striking face, a face member, etc.), such as stainless steel, titanium alloys, aluminum alloys, magnesium alloys, etc.; polymeric materials (e.g., for the crown or sole portions, for the club head body portions between the crown and sole portions, for the face member, etc.); composite materials, including fiber or particle reinforced composite materials, such as carbon fiber composite materials, basalt fiber composite materials, fiberglass materials, etc. (e.g., for the crown or sole portions, for the club head body portions between the crown and sole portions, for the face member, etc.); and combinations of these materials; etc. As yet another example, if desired, the club head body 112 may have a unitary one piece construction, optionally with the frame member integrally formed therein, and further with a separate removable weight portion (and optionally a separate weight insert, if desired) engaged therewith. Any desired structure and/or arrangement of the club head body structure and/or its various parts may be used without departing from this invention.

Additionally, the golf club 100 or golf club head 110 may include a means for changing a sound emanated by the club head body 112 when a golf ball contacts the ball striking face 114. The sound emanated or issued by the golf club 100 or golf club head 110 during a golf ball strike may be changed by "tuning" the means for changing the sound. The means for changing the sound may allow a user to selectively change the sound emanated by the club head body 112 when the golf ball contacts the ball striking face 114. The means for changing the sound may include both a borehole insert 120 located in and extending through the club head body 112 and a post 130, wherein the post 130 optionally may engage the borehole insert 120 in a slidable manner. Once the means for changing the sound is secured in the borehole insert 120, the club head body 112 will have a certain sound characteristic when it strikes a golf ball. By changing the features of the post 130, a user can change the vibrational characteristics associated with the club head body 112 when a golf ball is struck, thereby changing the sound emanating from the club head 110 when a golf ball is struck. The features of the post 130 may be changed, for example, by altering a construction of the post (e.g., by adding or subtracting one or more layers of material from the post), by changing an orientation of the post with respect to the club head body, by changing a force applied to the club head body by the post (e.g., by increasing or decreasing a length of the post within the club head body interior), by exchanging one post for another (e.g., of different size, cross-sectional shape, materials, etc.), by compressing a material of the post against the crown, by changing features of a weight member engaged with the post, etc.

Figure 2:
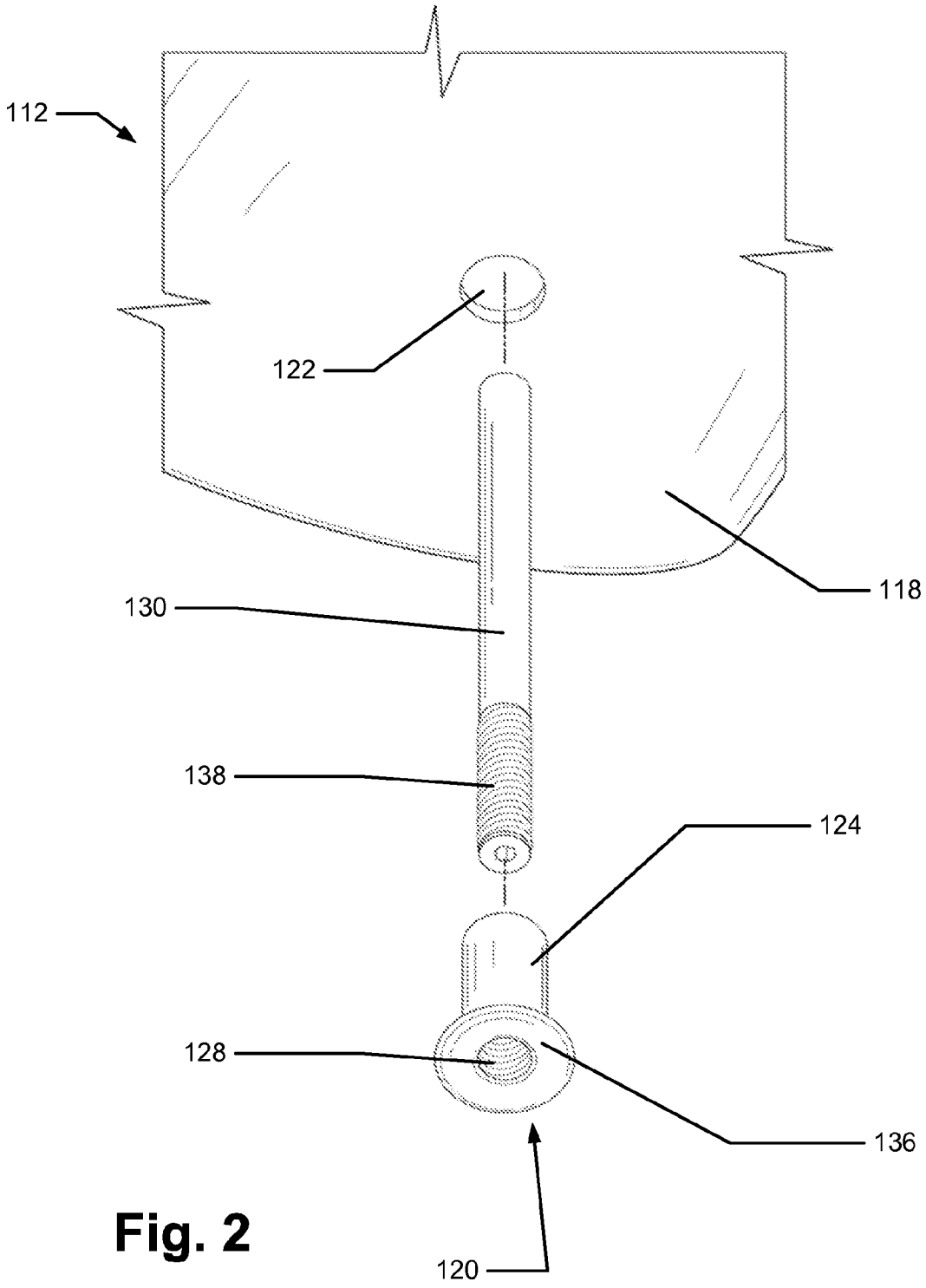
FIG. 2 illustrates a perspective close-up view of a golf club head and a post according to this invention.

As illustrated in FIG. 2, a first portion of the means for changing the sound in this example structure is the borehole insert 120. The borehole insert 120 may be located at the sole 118 of the club head body 112. The borehole insert 120 may begin at a sole opening 122 (or the borehole) at the sole of the club head body 112. The borehole insert 120 may extend into the interior of and/or through the club head body 112 from the sole portion 118 toward the crown portion 116. Additionally, if desired, the borehole insert 120 may extend to the inside of the crown portion of the club head body 112. The inside of the borehole insert 120 may be configured to receive the post 130. For example, the borehole insert 120 may include internal threads 128 that optionally are located at least near or adjacent to the sole opening 122. In an alternate embodiment, the internal threads 128 may be located in other locations throughout the borehole insert 120, such as at or near the crown portion 116, or toward the middle of the borehole insert 120. The internal threads 128 may also extend the entire length of the borehole insert 120. Alternatively, the borehole insert 120 may include other engagement means to engage the post 130 (e.g., by screw, set screw, or other mechanical connector attachments, by spring-loaded connections, by sliding attachments, etc.).

Figure 3A:
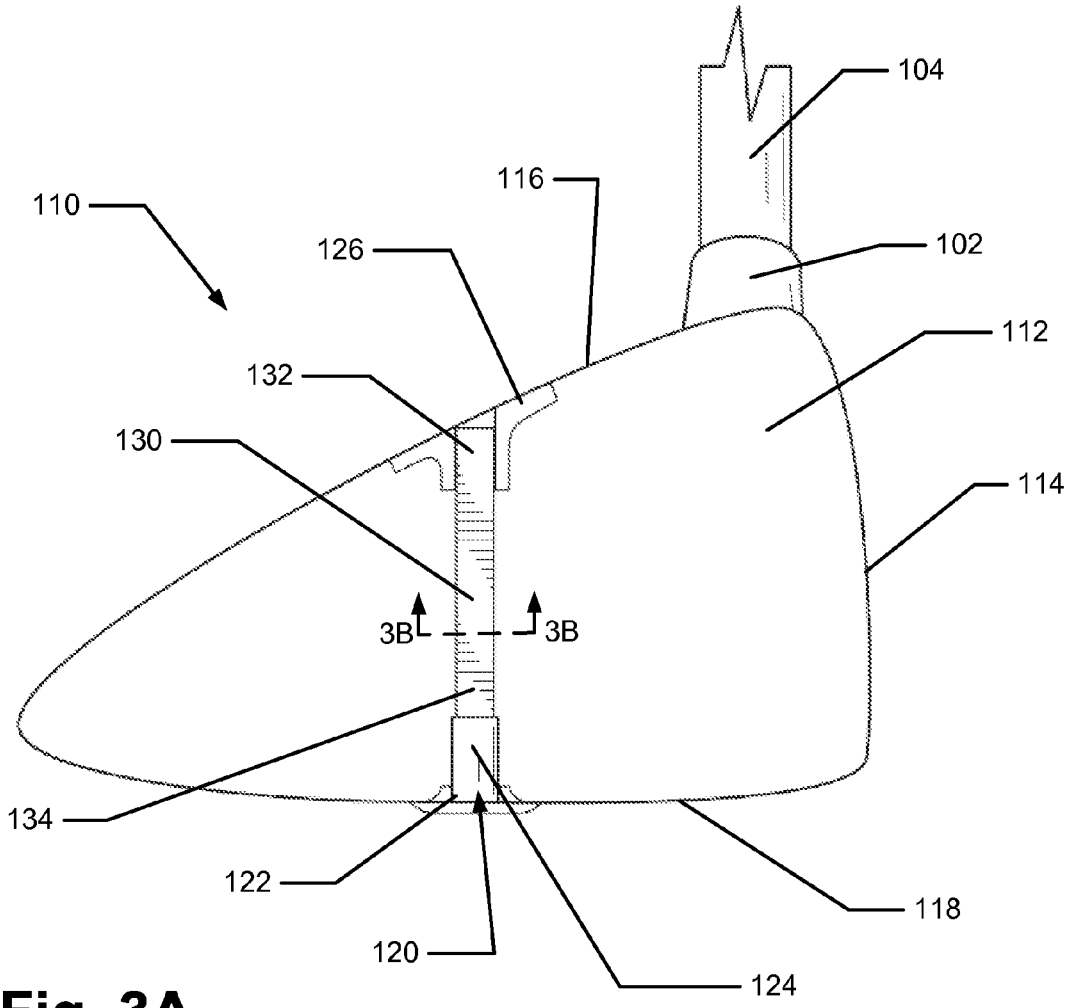
FIG. 3A illustrates a side view of an example golf club head according to this invention.

Additionally, as illustrated in FIGS. 2 and 3A, the borehole insert 120 may include support structures to help maintain the post 130 secure within the borehole insert 120. The borehole insert 120 may include a sole support 124 and/or a crown support 126. The sole support 124 may be located near or adjacent to the sole opening 122 (and optionally engaged with the sole portion 118 at the opening 122, e.g., via cements or adhesives). The sole support 124 may be attached or engaged to an inside surface of the sole portion 118. The sole support 124 may be tubular shaped and extend upward from the sole portion 118. The sole support 124 may be other different shapes without departing from this invention. The sole support 124 may have a smooth internal surface to receive the post 130, or it may include internal threads 128 to receive and engage with threads provided on the post 130. The crown support 126, which may be separate from or connected with the sole support 124 and/or the borehole insert 120, may be located near or adjacent to the crown portion 116 of the club head body 112. The crown support 126 may be attached or engaged to an inside surface of the crown portion 116. The crown support 126 may be tubular shaped and extend downward from the crown portion 116. The crown support 126 may have a smooth internal surface to receive the post 130, or it may include internal threads to receive and engage with threads provided on the post 130.

Any desired materials may be used for both the sole support 124 and the crown support 126, including conventional materials that are known and used in the golf club construction art, such as stainless steel, titanium and/or its alloys, aluminum and/or its alloys, magnesium and/or its alloys, etc.; polymeric materials; composite materials, including fiber or particle reinforced composite materials, such as carbon fiber composite materials, basalt fiber composite materials, fiberglass materials, etc. The sole support 124 and the crown support 126 may be engaged to the sole portion 118 and crown portion 116 respectively in any desired manner, including in manners that are known and used in the art. For example, the engaging means may include one or more of: bonding using adhesives or cements; engaging using welding, brazing, soldering, or other fusing techniques; attachment using mechanical connectors (such as screws, bolts, nuts, or the like); and the like. Alternatively, if desired, the sole support 124 may be integrally formed as part of the sole portion 118 and/or the crown support 126 may be integrally formed as part of the crown portion 116. As another alternative, if desired, the sole support 124 may be integrally formed with the borehole insert 120 (as may the crown support 126).

As further illustrated in FIGS. 2 and 3A, a second portion of the means for changing the sound is the post 130. The post 130 may have two ends, a first end 132 and a second end 134 opposite the first end 132. The first end 132 of the post 130 may be configured to be inserted into the sole opening 122 and extend and slide into the borehole insert 120 of the club head body 112. The second end 134 of the post 130 may include a head structure 136 (see FIGS. 2 and 3C). The head structure 136 may include a slot or shaped hole for screwing in or engaging the post 130 within the borehole insert 120. The slot or shaped hole may be for a screwdriver, Phillips head screwdriver, an Allen wrench, or other shaped wrench, for example. The second end 134 and head structure 136 of the post 130 may be configured to be substantially flush to the sole portion 118 of the club head body 112. The head structure 136 may be filled in or otherwise cosmetically covered to create a smooth surface on the sole portion 118 of the club head. A screw head cover may be utilized to cover the head structure 136 without departing from this invention. Additionally, as shown in FIG. 2, the post may include external threads 138 configured to engage the internal threads 128 of the borehole insert 120.

Figure 3B:
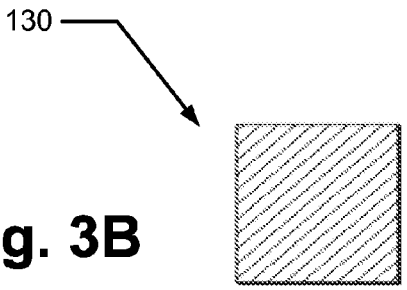
FIG. 3B illustrates a cross-sectional view of the post from the golf club head of FIG. 3A taken along lines 3B-3B of FIG. 3A.
Figure 3C:
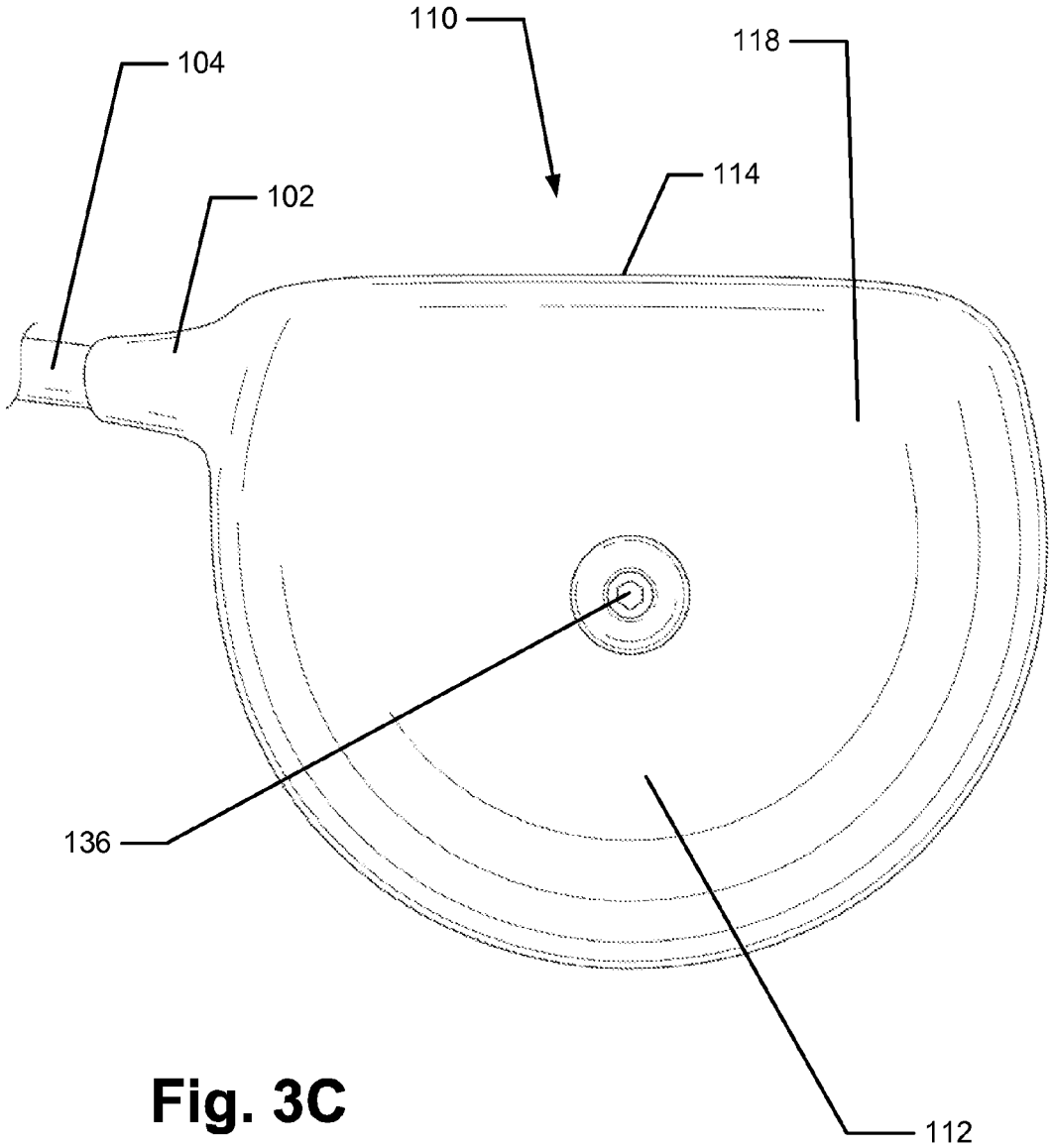
FIG. 3C illustrates a bottom view of the golf club head of FIG. 3A.
Figure 4A:
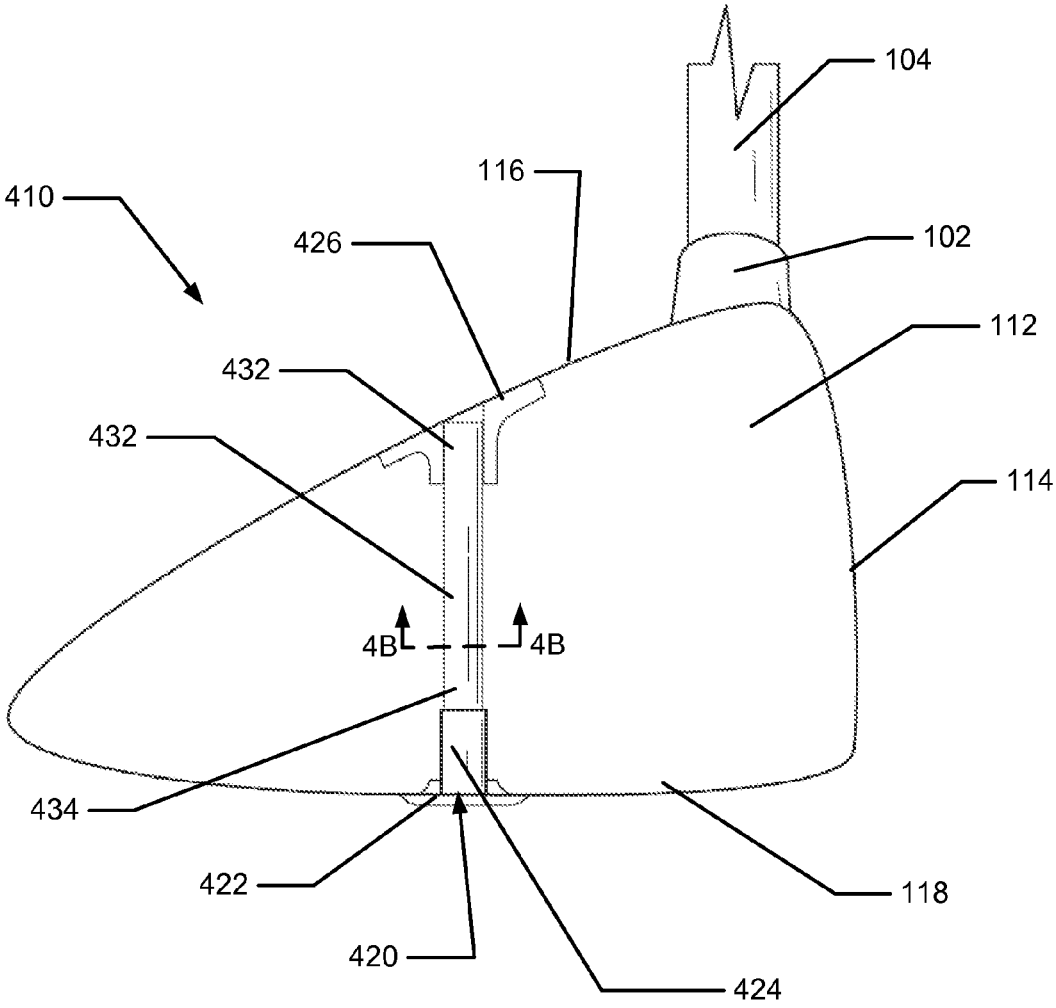
FIG. 4A illustrates a side view of another example golf club head according to this invention.
Figure 4B:
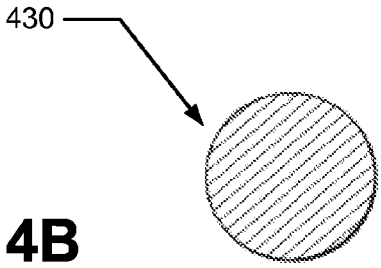
FIG. 4B illustrates a cross-sectional view of the post from the golf club head of FIG. 4A taken along lines 4B-4B of FIG. 4A.
Figure 5A:
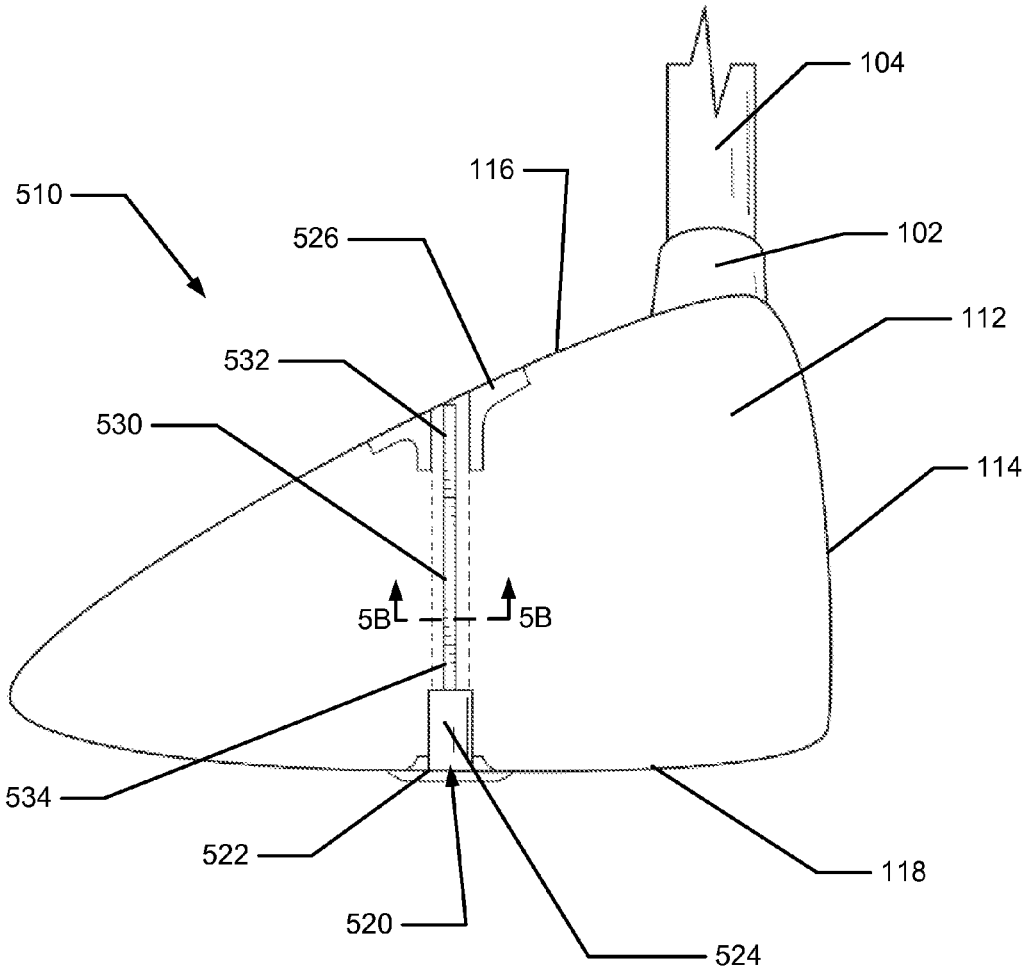
FIG. 5A illustrates a side view of another example golf club head according to this invention.
Figure 5B:
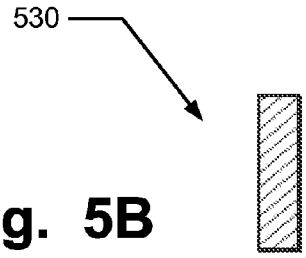
FIG. 5B illustrates a cross-sectional view of the post from the golf club head of FIG. 5A taken along lines 5B-5B of FIG. 5A.

The cross-section of the post 130 may be one of many various shapes, such as circular, oval, square, rectangular, triangular, flat, etc, without departing from this invention. As illustrated in FIGS. 3A and 3B, the cross-section of the post 130 in this example structure is square or rectangular. Additionally, as illustrated in FIGS. 4A and 4B, the cross-section of the post 130 in this example structure is circular. Additionally, as illustrated in FIGS. 5A and 5B, the cross-section of the post 130 is flat (essentially rectangular).

The post 130 may be made of a variety of materials without departing from this invention, such as stainless steel, titanium and/or its alloys, aluminum and/or its alloys, magnesium and/or its alloys, steels, etc.; polymeric materials (including compressible materials like rubbers or foams, etc.); composite materials, including fiber or particle reinforced composite materials, such as carbon fiber composite materials, basalt fiber composite materials, fiberglass materials, etc.

As illustrated in FIGS. 2 and 3A, the post 130 may be inserted into the borehole insert 120 of the club head body. The first end 132 of the post 130 may be inserted into the sole opening 122, wherein the first end 132 slides into and through the borehole insert 120. The user may continue to slide the post 130 into the sole opening 122 and the borehole insert 120 until a fastening means is reached. Once the fastening means is reached, the user may fasten the post 130 to the borehole insert 120 and club head body 112. In the example of a threaded engagement, the user may rotate the post 130 to engage the external threads 138 of the post 130 to the internal threads 128 of the borehole insert 120. While the user slides or rotates the post 130 inside the club head body 112 and the borehole insert 120, the first end 132 of the post 130 may slide into and be supported by the crown support 126. Additionally, if the post 130 has a rubber tip 140, the rubber tip 140 may extend against and compress into the inside of the crown portion 116. The user may continue rotating the post 130 until the post 130 is completely engaged within the borehole insert 120 and the club head body 112. Once the post 130 is completely engaged within the borehole insert 120 and the club head body 112, the second end 134 and the head structure 136 may be substantially flush with or countersunk into the sole portion 118. Additionally, the second end 134 of the post 130 may be supported by the sole support 124 near or adjacent to the sole opening 122. To remove the post 130, the user may rotate the post 130 in the opposite direction to disengage the external threads 138 of the post 130 from the internal threads 128 of the borehole insert 120. Once the threads 128, 138 are disengaged, the user may slide the post 130 out of the borehole insert 120, thereby removing the post 130 from the club head body 112. Also, if desired, the post 130 may be freely and selectively removed from the borehole insert 120 and club head body 112 as described above, to thereby allow further selective change or customization of the sound emanating from the club head body 112 when a golf ball contacts the ball striking face 114.

Changing the "sound" associated with hitting a golf ball on the ball striking face 114 can change the "feel" of the club (e.g., a metallic "ring" sound versus a softer "thud" sound, etc.). Once the means for changing the sound (e.g., the post 130) is secured in the borehole insert 120, the club head 110 will have a certain sound characteristic when it strikes a golf ball. For example, a club head 110 may produce a sound when the golf ball hits the ball striking face 114 in the range of approximately 110 decibels to approximately 125 decibels with the post 130 at a first torque or compression level and in a range of approximately 120 decibels to approximately 140 decibels with the post 130 at a second torque or compression level (and the user is allowed to adjust the post's torque or compression levels). Additionally, without departing from this invention, the club head 110 may include other posts, torque levels, or other adjustment means to alter the decibel level in various other ranges, such as a range of approximately 110 decibels to approximately 120 decibels. In another example according the this invention, the decibel level range may be from approximately 120 decibels to approximately 130 decibels. In another example according this invention, the decibel level range may be from approximately 130 decibels to approximately 140 decibels. In another example according this invention, the decibel level range may be from approximately 110 decibels to approximately 130 decibels. In another example according this invention, the decibel level range may be from approximately 120 decibels to approximately 140 decibels.

As another example, a club head 110 may produce a sound frequency when the golf ball hits the ball striking face 114 in the range of approximately 2,500 Hz to approximately 3,000 Hz with the post 130 at a first torque or compression level and in a range of approximately 4,500 Hz to approximately 6,500 Hz with the post 130 at a second torque or compression level. The frequency level of the golf club head 110 may be altered based on different posts, torque levels, or other adjustment means, wherein the frequency is between approximately 2,500 Hz and approximately 7,000 Hz, or wherein the frequency is between approximately 2,900 Hz and approximately 6,500 Hz, or wherein the frequency is between approximately 4,000 Hz and approximately 6,000 Hz.

The sound (e.g., tone, intensity (e.g., dB level), and/or frequency, etc.) emanated or issued by the golf club 100 or golf club head 110 during a golf ball strike may be changed by "tuning" the means for changing the sound. As described above, there are many features of the post 130 and post/borehole insert 130/120 combination that may be varied for this invention. Each of these different features and combinations may allow the user to selectively change the sound emanated by the club head 110 when a golf ball contacts the ball striking face 114. By changing the features of the post 130 and post/borehole insert 130/120 combination, a user can change the vibrational characteristics associated with the club head 110 when a golf ball is struck, thereby changing the sound emanating from the club head 110 when a golf ball is struck.

In another example according to this invention, as illustrated by FIGS. 3A, 4A, and 5A, the cross-sectional shape of the post 130, 430, 530 may be selectively varied to alter the sound emanating from the club head 110 when a golf ball contacts the ball striking face 114. As was described above, the cross-sectional shape of the post 130, 430, 530 may be many different shapes and sizes without departing from this invention. For example, as illustrated in FIG. 3A, the post 130 may have a rectangular cross-section, as illustrated in FIG. 4A, the post 430 may have a circular or round cross-section, and as illustrated in FIG. 5A, the post 530 may have a flat cross-section. The cross-sectional shape of the post may be varied without departing from the invention, and changing the cross-sectional shape may change the sound associated with the club head.

In an alternative example according to this invention, the length of the post 130 may also vary without departing from this invention. As illustrated in FIG. 3A, the length of the post 130 may extend so that the first end 132 is located near or adjacent to the crown portion 116 of the club head 110. If desired, a compressible material may be provided in the crown supports 126 (e.g., as a rubber end cap on post 130 as a foam insert piece, etc.) to enable various pole lengths to be accommodated, to enable application of a variety of different forces, and to help prevent movement or rattling of the post 130 within the supports 126. Additionally or alternatively, the supports 126 or portions thereof may be made from a compressible material. Alternatively, as illustrated in FIG. 6, the length of the post 630 may extend so that the first end 632 is located toward the middle of the club head body 112 and does not extend near or adjacent to the crown portion 116.

Figure 6:
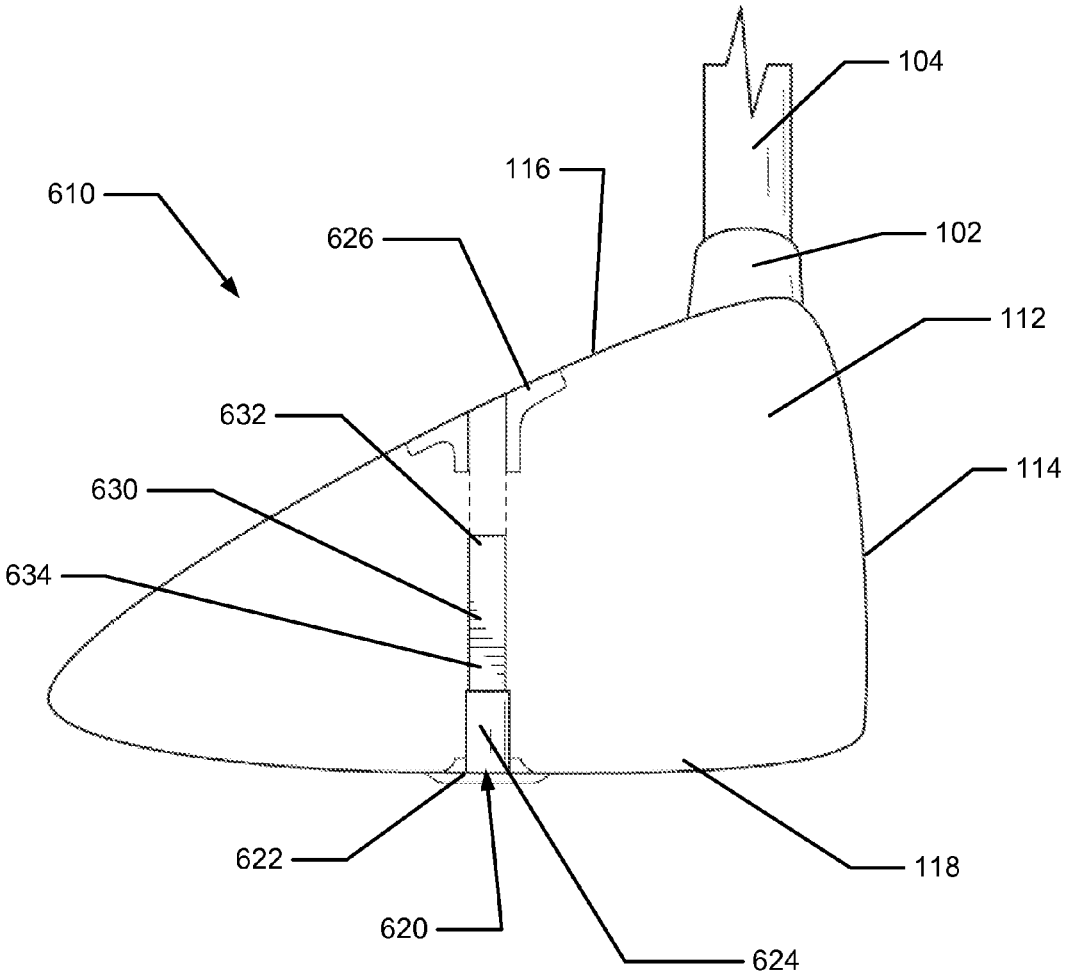
FIGS. 6 through 8 illustrate side views of other example golf club heads according to this invention.

Additionally, as illustrated in FIG. 3 and FIG. 6, as the length of the post 130, 630 may be selectively varied to alter the sound emanating from the club head 110 when a golf ball contacts the ball striking face 114. In this example, as the length of the post 130, 630 is varied (by replacing one post 130, 630 with the other), a different sound, pitch or frequency is emanated from the club head 110. Additionally, the first end 132, 632 of the post may extend all the way to the crown 116 of the club head 110. By extending the post 130, 630 to the crown portion 116 of the club head 110, the post may deaden or isolate the crown frequency. The length of the post 130, 630 can be varied to any length without departing from the invention.

Figure 7A:
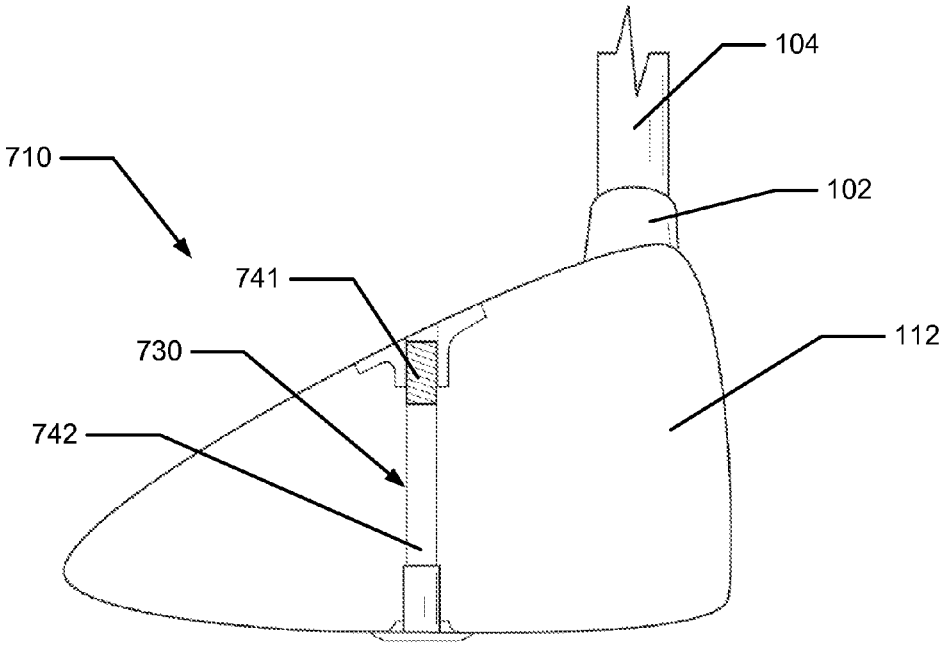
Figure 7B:
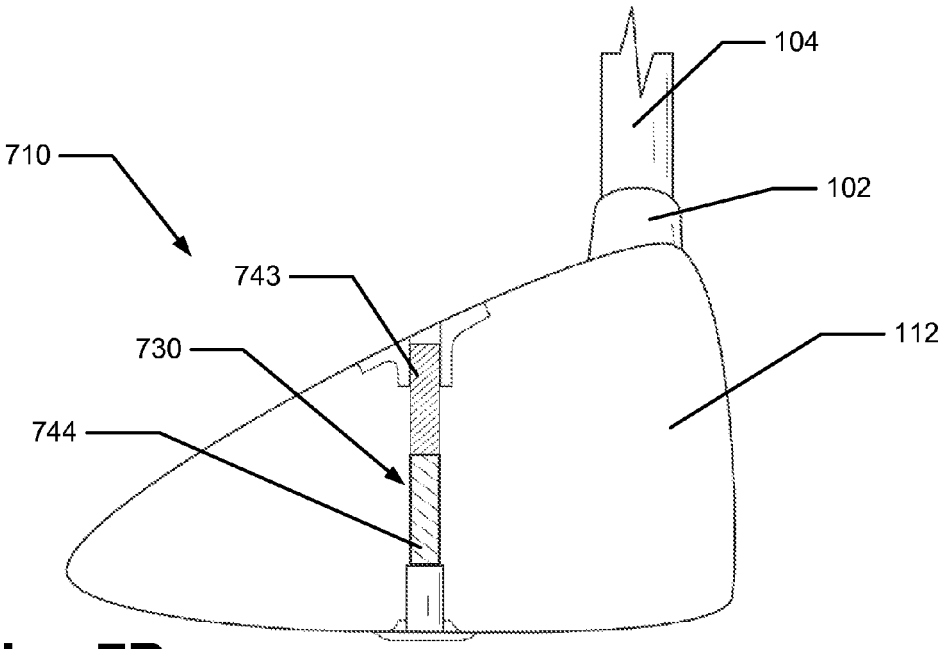

In an alternative example according to this invention, the club head 710 may include a post 730 that is made of multiple materials. As illustrated in FIG. 7A, the post 730 may be made of a first material 741 and a second material 742. The first material 741 and the second material 742 may be different materials. The first material 741 may be engaged or attached to the second material 742 in any desired manner, including in manners that are known and used in the art, which may include one or more of: bonding using adhesives or cements; engaging using welding, brazing, soldering, or other fusing techniques; attachment using mechanical connectors (such as screws, bolts, nuts, or the like); and the like. As illustrated in FIG. 7A, the first material 741 may be located near the crown portion 116 or top of the club head body 112 and the second material 742 may be located closer to the sole portion 118 or bottom of the club head body 112. FIG. 7B illustrates a similar structure to the post 730 as shown in FIG. 7A, but this post 730 includes a third material 743 and a fourth material 744. Additionally, the post 730 may include more than two different materials, such as three, four, or five materials without departing from this invention. The amount of each of the multiple materials for the post 730 may also vary without departing from this invention. For example, as illustrated in FIG. 7A, the post 730 may contain approximately 25% of the first material 741 and 75% of the second material 742. In contrast, as illustrated in FIG. 7B, the post 730 may contain approximately 50% of both the third material 743 and the fourth material 744. If desired, the posts 730 could be structured so that either end is engagable with the borehole insert, and the sound produced by the club head may be altered by flipping the post 730 end-for-end.

Additionally, as illustrated by FIGS. 7A and 7B, the material of the post 730 may be selectively varied to alter a sound emanating from the club head 710 when a golf ball contacts the ball striking face 114. As was described above, the material of the post 730 may be one of many different materials. Each of the different materials may have a different effect on changing the sound that emanates from the club head 710 when a golf ball contacts the ball striking face 114. Additionally, the post 730 may contain more than one different material. Each of the different combinations of multiple materials may have a differing effect on changing the sound that emanates from the club head 710 when a golf ball contacts the ball striking face 114. As was discussed above, when the post 730 is made from more than one material, there may be differing amounts and percentages of one material versus another material. Each of the differing amounts or percentages of multiple materials may have a different effect on changing the sound that emanates from the club head 710 when a golf ball contacts the ball striking face 114. The type of material, amount of material, and number of materials of the post 730 may be varied without departing from this invention. In such constructions, flipping the post 730 with respect to the club head body also may be used to change the sound of the club (by placing a different type of material in contact with the inside surface of the crown).

Figure 8:
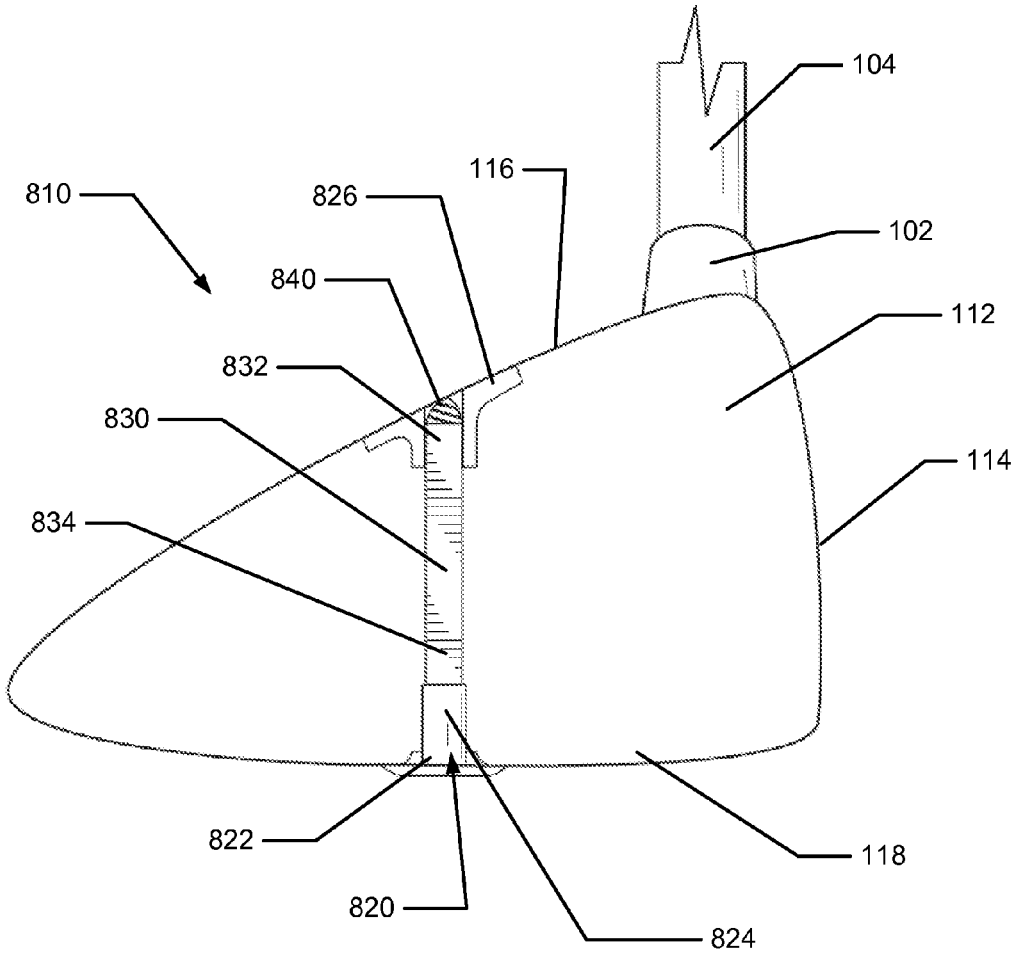

In an alternative example according to this invention, as illustrated in FIG. 8, the club head 810 may include a post 830 with a rubber tip 840 or cap on the first end 832 of the post 830. The rubber tip 840 may extend to and compress against the crown portion 116 of the club head body. The rubber tip 840 may be made of a variety of different rubber-type materials without departing from this invention, such as: natural rubber, silicone compound rubbers, nitrile (Buna-N) rubbers, polybutadiene rubbers, polymer-based rubbers, etc. The rubber tip 840 may be attached to the first end 832 by various ways known in the art, which may include one or more of: bonding using adhesives or cements; engaging using welding, brazing, soldering, or other fusing techniques; attachment using mechanical connectors (such as screws, bolts, nuts, or the like); friction fits (e.g., as a cap member); and the like.

Additionally, as illustrated in FIG. 8, the club head 810 may include a post 830 with a rubber tip 840 which may allow the user to selectively alter the sound emanating from the club head 810 when a golf ball contacts the ball striking face 114. When the post 830 includes the rubber tip 840 on the first end 832 of the post 830, the rubber tip 840 may extend to and compress against the inside of the crown portion 116 of the club head 810. This extension and compression of the rubber tip 840 against the crown portion 116 may isolate or deaden a frequency that is emanated by the crown 116, thereby changing or altering the sound of the club head 810. The size, shape, and type of rubber of the rubber tip 840 may be changed to further alter the sound of the club head 810 without departing from this invention. Changes in the torque or force applied by the post 830 to the crown portion 116 also may be used to control and "tune" the sound produced by the club. If desired, some portion of the longitudinal length of the post 830 may be made from a compressible material, to allow better control and tuning of the applied force (and thus the produced sound).

Figure 9:
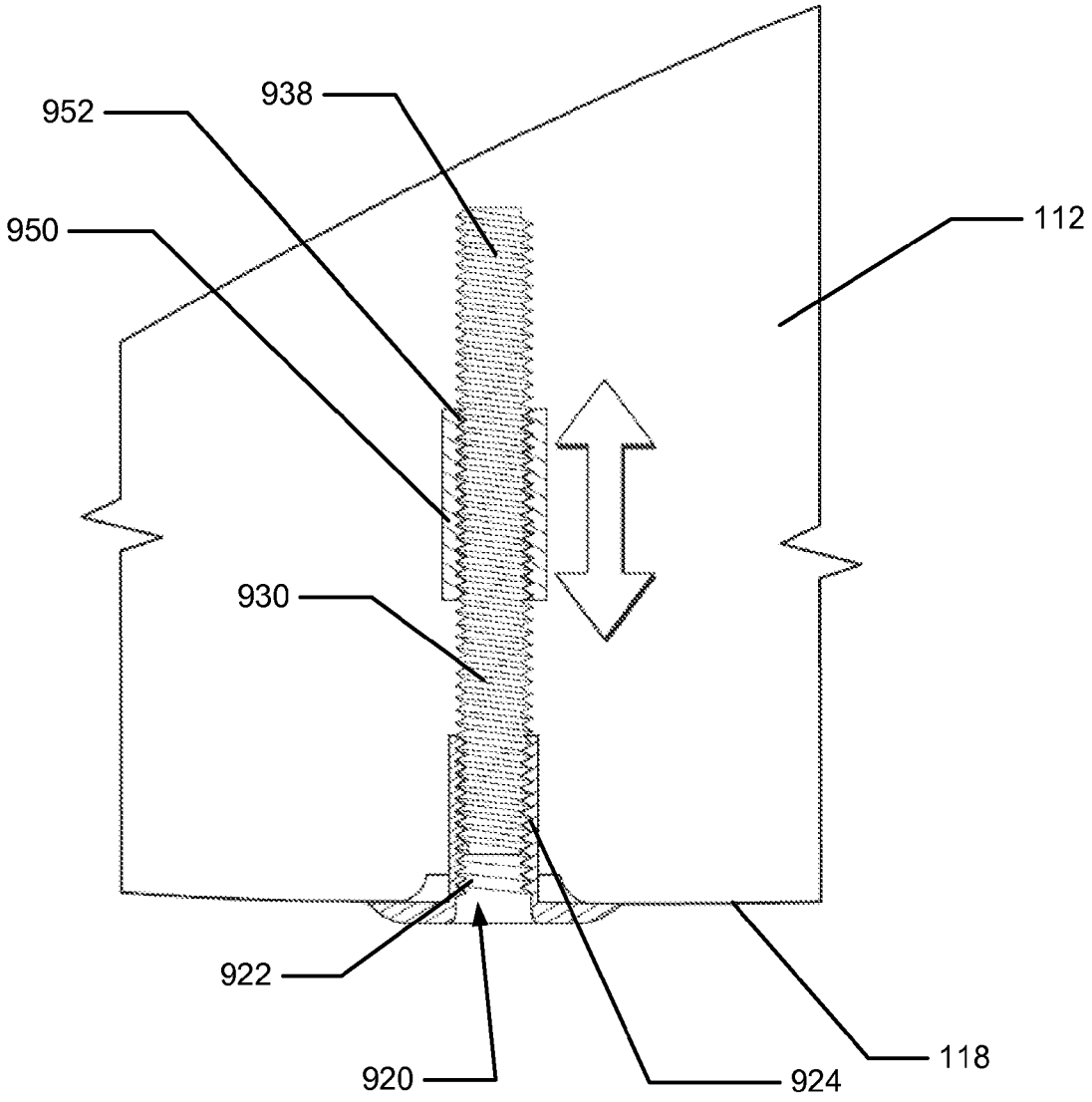
FIG. 9 illustrates a close-up side view of another example golf club head with a rotatable weight according to this invention.

In another example according to this invention, as illustrated in FIG. 9, the club head 910 may include a post 930 with one or more weights 950. The weight(s) 950 may be located along the post 930. In the example as illustrated in FIG. 9, the weight 950 is in the shape of a sleeve that surrounds a portion of the post 930. The weight 950 may also be other shapes without departing from this invention. Additionally, the sleeve or weight 950 may be different sizes and different masses without departing from this invention. The weight 950 may include a fastening means to the post 930. The fastening means allows the location of the weight 950 to be varied along the post 930 by a user. The location of the weight 950 may be varied by unfastening the weight 950, moving the weight 950 along the post 930, and refastening the weight 950 in a different location. The fastening means as illustrated in FIG. 9 includes a threaded engagement between the post 930 and the weight 950. The weight 950 may contain internal threads 952 that may engage with the external threads 938 of the post 930, thereby allowing the weight 950 to move longitudinally up and down the post 930. The weight 950 as illustrated in FIG. 9 may be moved up and down the post 930 by rotating the weight 950 along the post 930. The fastening means of the weight 950 may be any other type of fastening means known in the art without departing from this invention (e.g., by screw, set screw, or other mechanical connector attachments, by sliding attachments, etc.). The weight 950 may also be made of various different materials without departing from this invention including: metal materials (such as titanium, magnesium, tungsten, lead, aluminum, etc.); or metal alloys (such as alloys of steel, alloys containing titanium, magnesium, tungsten, lead, or aluminum, etc.); composite materials (such as carbon fiber composites, basalt fiber composites, etc.), optionally doped with a denser weight material; and polymeric materials (optionally doped with a denser weight material). In some instances, no separate fastening structure will be needed to hold the weight(s) 950 in place with respect to the post 930 (e.g., if a friction fit is sufficient to maintain the weight's location on the post).

Additionally, as illustrated in FIG. 9, the post 930 may include a weight 950, wherein the location of the weight 950 along the post 930 may allow the user to selectively alter the sound emanating from the club head 910 when a golf ball contacts the ball striking face 114. The user may selectively move the weight 950 up or down along the post 930 to alter the sound emanating from the club head 910. Additionally, the shape and/or size of the weight 950 may be changed to allow the user to selectively alter the sound emanating from the club head 910 when a golf ball contacts the ball striking face 114. Additionally, the material of the weight 950 may be changed to allow the user to selectively alter the sound emanating from the club head 910 when a golf ball contacts the ball striking face 114. The location, shape, size, or material of the weight 950 may be changed without departing from the invention.

Figure 10:
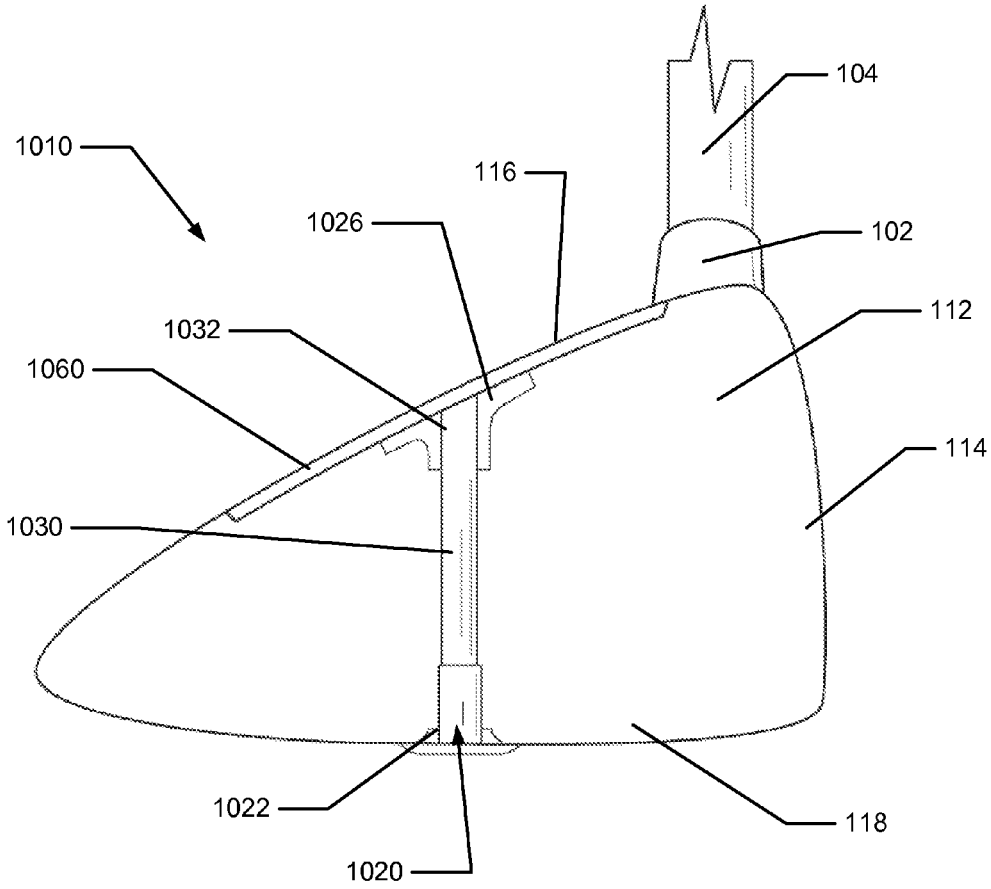
FIG. 10 illustrates a side view of another example golf club head with a plate according to this invention.

In another example according to this invention, as illustrated in FIG. 10, the club head 1010 may also include a plate 1060. The plate 1060 may be located between the second end 1032 or top of the post 1030 and the crown 116. Alternatively, the plate 1060 may be located between the crown support 1026 and the crown 116. The plate 1060 may be utilized to spread out the pressure exerted from the post 1030 over a larger surface area of the crown 116. The plate 1060 may help prevent damaging the crown 116 if excessive force were applied to the post 1030. Additionally, the plate 1060 may allow the user an additional means to selectively alter the sound emanating from the club head 1010 when a golf ball contacts the ball striking face 114. The size and/or shape of the plate 1060 may be changed to allow the user to selectively alter the sound emanating from the club head 1010 when a golf ball contacts the ball striking face 114. Additionally, the material of the plate may be changed to allow the user to selectively alter the sound emanating from the club head 1010 when a golf ball contacts the ball striking face 114. The shape, size, or material of the plate 1060 may be changed without departing from the invention.

Figure 11A:
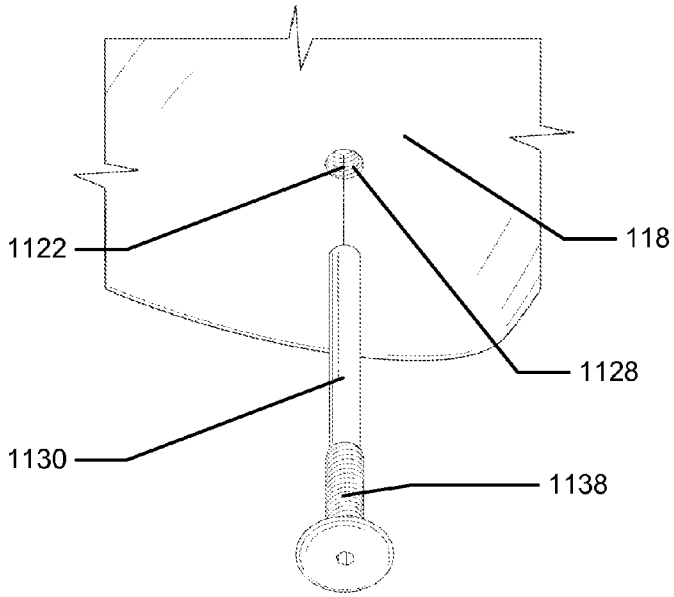
FIG. 11A illustrates a perspective close-up view of another example golf club head and post according to this invention.
Figure 11B:
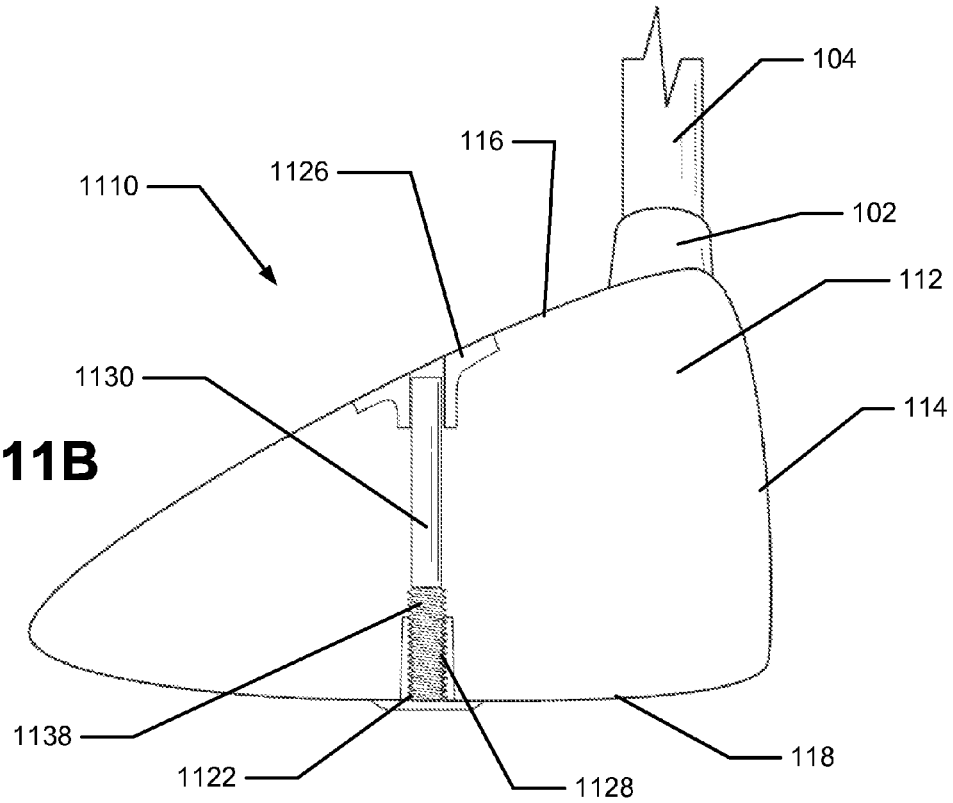
FIG. 11B illustrates a side view of the golf club head from FIG. 11A according to this invention.

Additionally, alternative constructions for the means for changing the sound may be included without departing from the invention. In another example according to this invention, as illustrated in FIGS. 11A and 11B, the club head 1110 may include a post 1130 that directly engages with a threaded hole 1122 provided in the club head sole 118. As compared to FIG. 3A, the borehole insert 120 from FIG. 3A has been eliminated. In this example, as illustrated in FIGS. 11A and 11B, the threaded hole 1122 may extend into the inside of the crown portion 116 of the club head body 112. The inside of the threaded hole 1122 may be configured to receive the post 1130. For example, the threaded hole 1122 may include internal threads 1128 that optionally are located at least near or adjacent to the sole 118 of the club head body 112, and the post 1130 may include external threads 1138 configured to engage the internal threads 1128 of the threaded hole 1122. In an alternate embodiment, the internal threads 1128 may be located in other locations through the threaded hole 1122, such as at or near the crown portion 116, or toward the middle of the threaded hole 1122. The internal threads 1128 may also extend the entire length of the threaded hole 1122.

Figure 12:
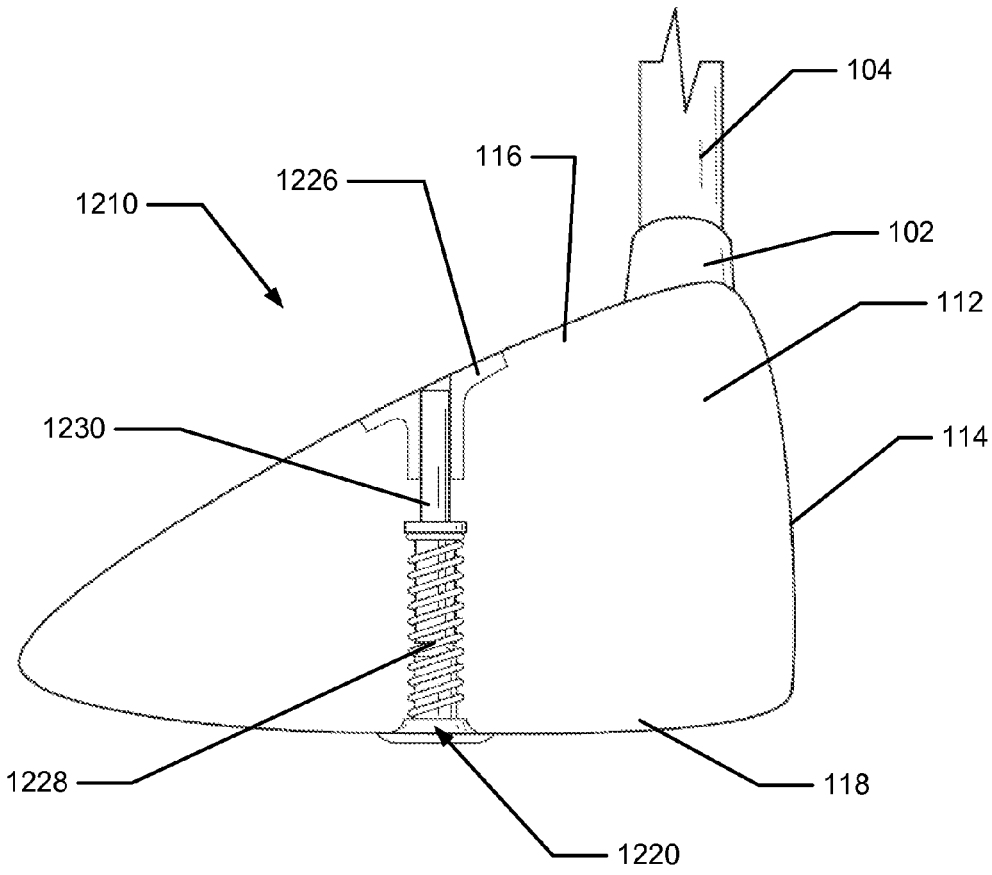
FIG. 12 illustrates a side view of another example golf club head according to this invention.

In another example according to this invention, as illustrated in FIG. 12, the club head 1210 may include a borehole insert 1220 with a spring-loaded connection means 1228 to engage the post 1230. In this example, the post 1230 may be inserted into the borehole insert 1220 wherein when the post 1230 is pressed or pushed into the borehole insert 1220, the post 1230 may engage with the spring-loaded connection means 1228. The post 1230 may then be locked and maintained within the borehole insert 1220. The post 1230 may then be removed from the borehole insert 1220 by pushing or pressing on the post 1230 and thereby exerting a force on the post 1230 toward the club head body 112 (if necessary or desired, the post 1230 may be somewhat compressible in its longitudinal direction and/or a compressible end may be provided near the crown 116 to enable the post to be displaced somewhat in the longitudinal direction to allow engagement and release of the post 1230 with respect to the club head 112). This force may unlock the post 1230 from the borehole insert 1220 and allow the removal of the post 1230 from the borehole insert 1220. Additionally, the post 1230 may be locked within the borehole insert 1220 by a quarter-turn lock or similar type action (e.g., a mechanism akin to child safety cap features of medicine or detergent bottles, or the like, may be used). Alternatively, the borehole insert 1220 may include other engagement means to engage the post (e.g., by screw, set screw, or other mechanical connector attachments, by sliding attachment, etc.).

Figure 13:
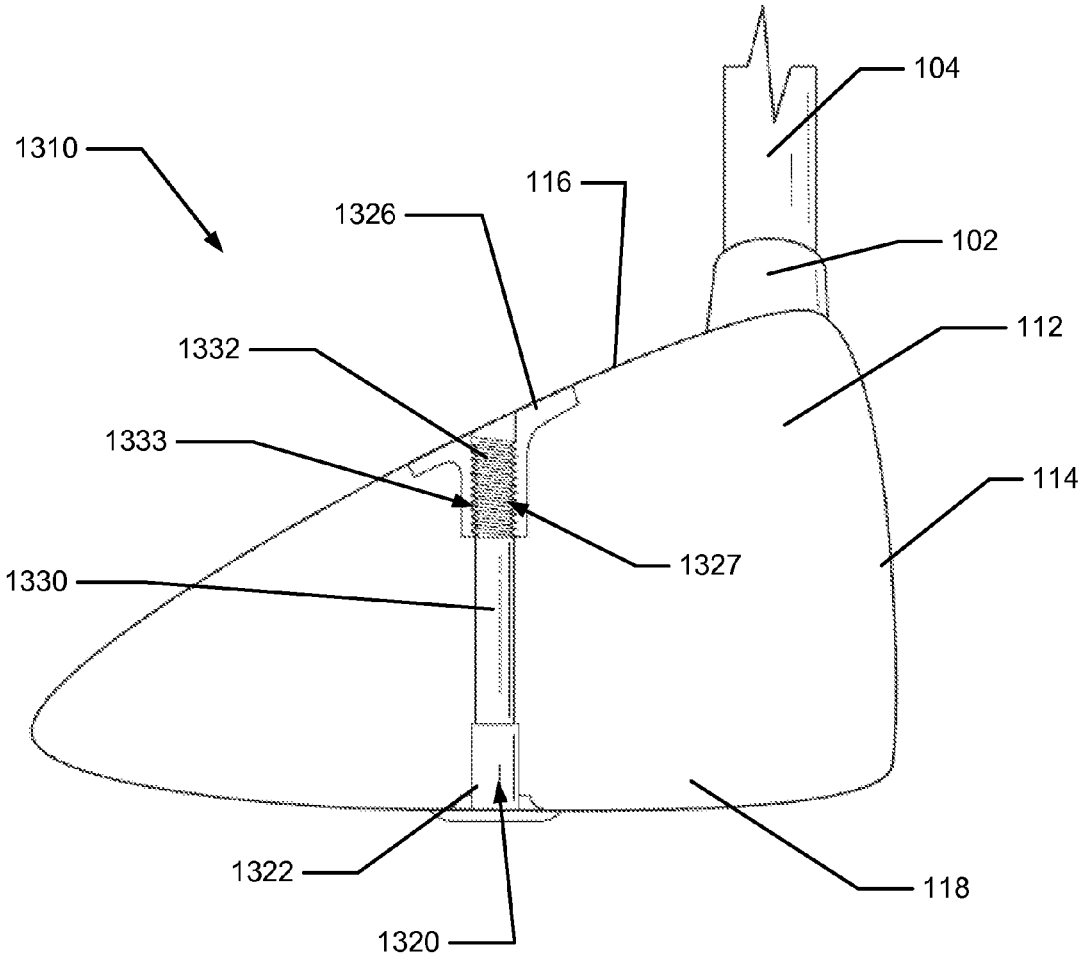
FIG. 13 illustrates a side view of another example golf club head according to this invention.

In another example according to this invention, as illustrated in FIG. 13, the club head 1310 may include a post 1230 with a male thread 1333 on the first end 1332 of the post 1330 to engage a female thread 1327 on the support 1326. In this example, the post 1230 may include male threads 1333 located on the first end 1332 of the post 1330. Additionally, the support 1326 may include female threads 1327 located inside the opening that receives the post 1330. As the post is inserted into the borehole insert 1320, the male threads 1333 on the first end of the post 1330 may threadedly engage the female threads 1327 on the support 1326. This threaded connection between the post 1330 and the support 1326 may give the user the ability to tighten or the crown 116 of the club head 1310 to thereby alter, minimize, or eliminate sounds emanating from the club head 1310 when a golf ball contacts the ball striking face 114.

Figure 14:
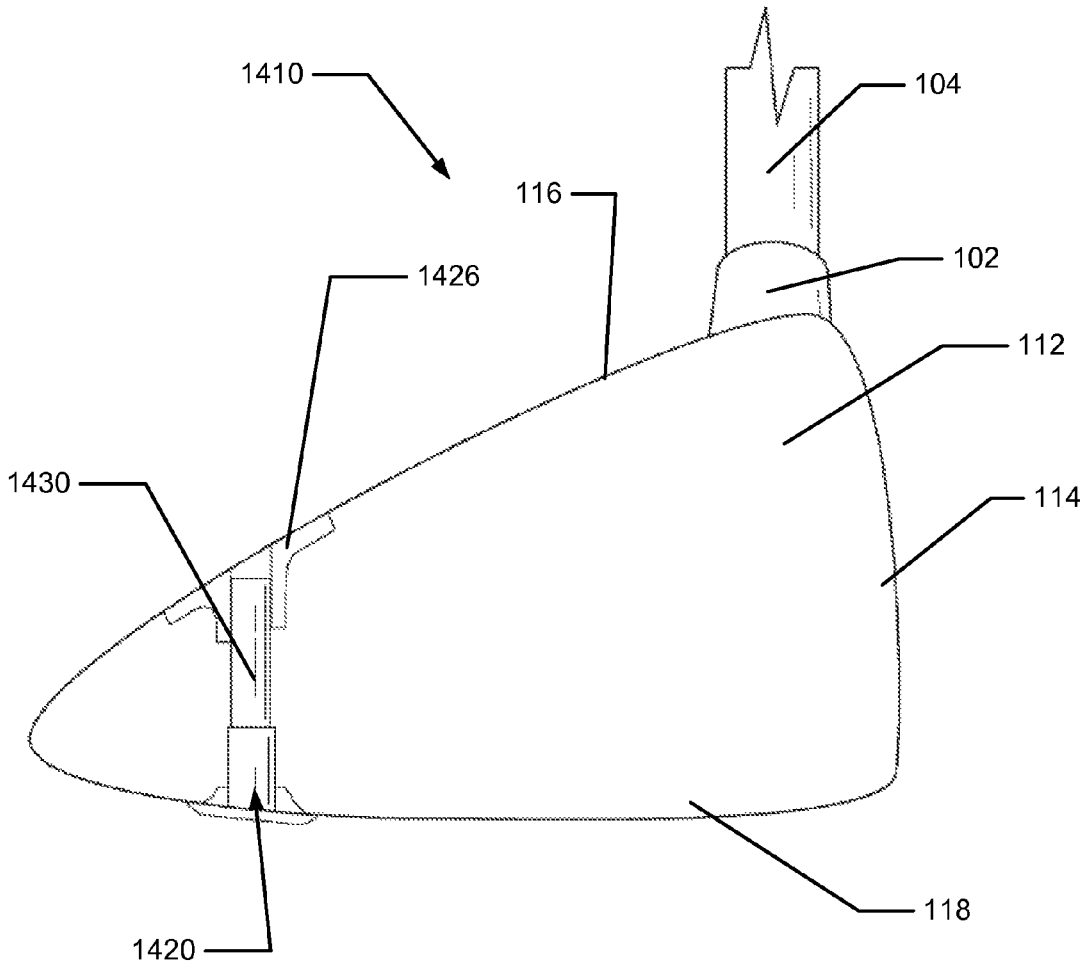
FIG. 14 illustrates a side view of another example golf club head according to this invention.

In another example according to this invention, as illustrated in FIG. 14, the club head 1410 may include a post 1430 that is located in a different location as is illustrated in FIG. 3B. In FIG. 3B, the post 130 is located in approximately the center of the club head 110. In the example club head 1410 illustrated in FIG. 14, the post 1430 is located near the back of the club head 1410, opposite the side with the ball striking face 114. Additionally, in other examples according to this invention, the post 1430 may be located at various other locations throughout the club head 1410 without departing from this invention.

Additionally, a club head 1410 with a post 1430 in the location as illustrated in FIG. 14 may have a different sound that emanates from the club head 110 when a golf ball contacts the ball striking face 114 than a club head 110 with a post 130 in the location as illustrated in FIG. 3A. Therefore, the user may selectively chose a club head 1410 with the post 1430 located in a preferred location to control and alter the sound emanating from the club head 1410 when a golf ball contacts the ball striking face 114. The location of the post 1430 within the club head 1410 may be changed without departing from the invention.

Figure 15A:
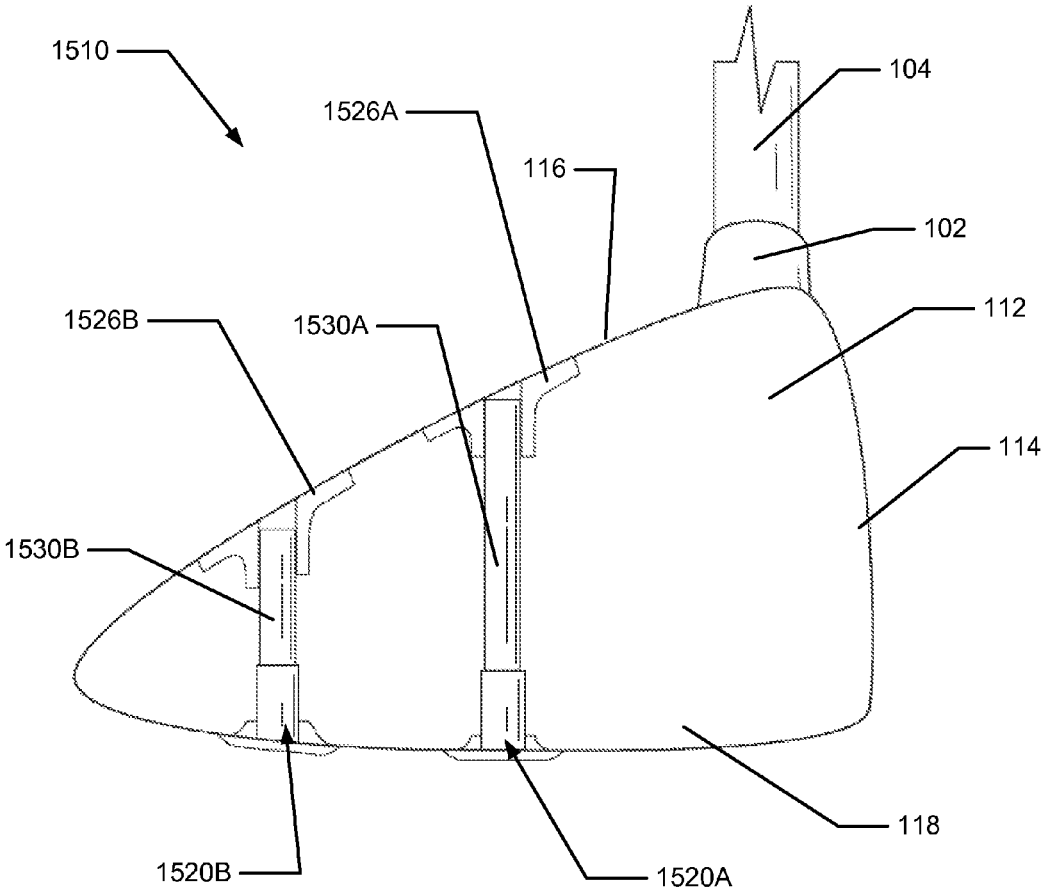
FIG. 15A illustrates a side view of another example golf club head according to this invention.
Figure 15B:
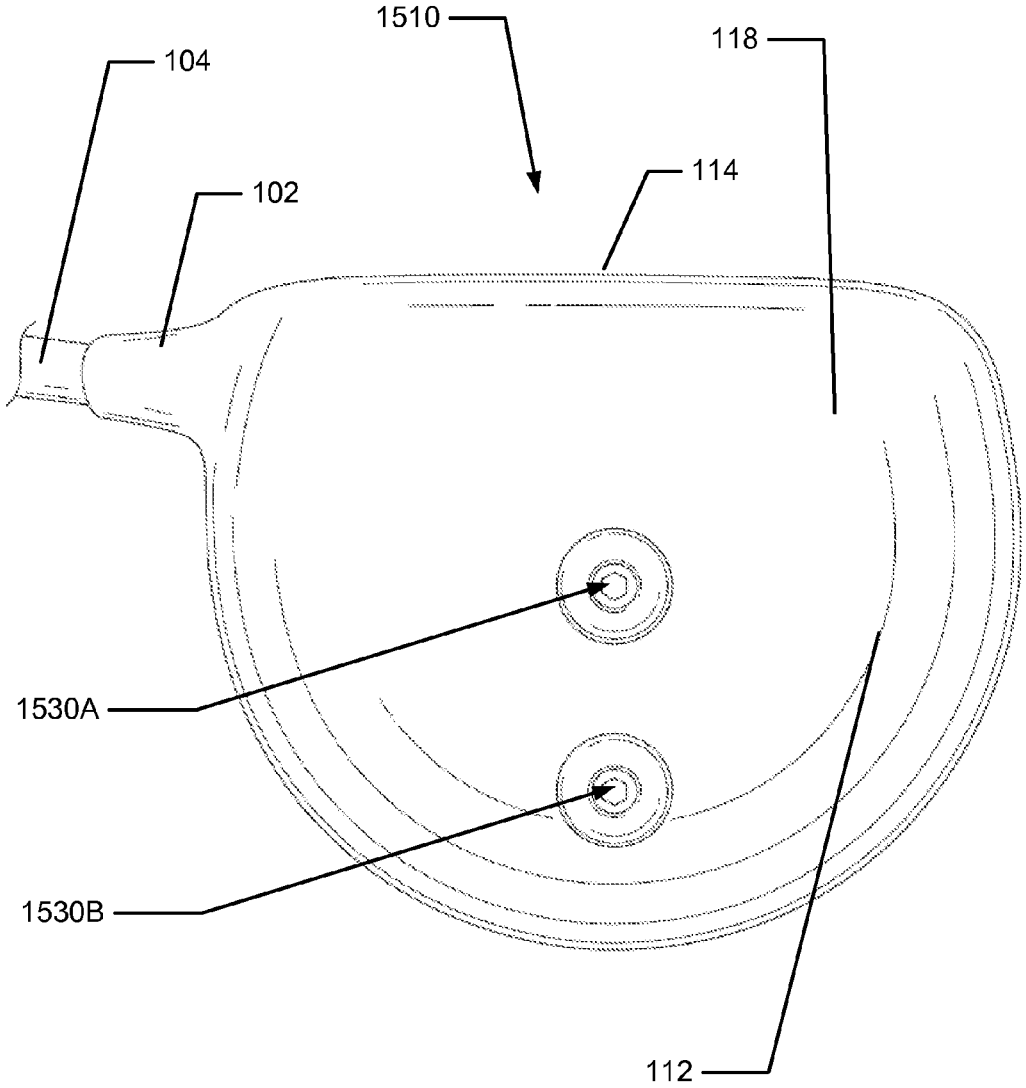
FIG. 15B illustrates a bottom view of the golf club head of FIG. 15A.

In another example according to this invention, as illustrated in FIGS. 15A and 15B, the club head 1510 may include multiple posts 1530A, 1530B. In FIG. 3B, the club head 110 includes only one post 130. In the example club head 1510 illustrated in FIG. 15, a first post 1530A is located in approximately the center of the club head 1510, while a second post 1530B is located towards the back of the club head 1510 opposite the side with the ball striking face 114. Additionally, in other examples according to this invention, the either the first post 1530A or the second post 1530B may be located at various other locations throughout the club head 1510 without departing from this invention.

Additionally, a club head 1510 with a first post 1530A and a second post 1530B as illustrated in FIG. 15 may have a different sound that emanates from the club head 110 when a golf ball contacts the ball striking face 114 than a club head 110 with a single post 130 as illustrated in FIG. 3A. Therefore, the user may selectively chose a club head 1510 with either one post or multiple posts to control and alter the sound emanating from the club head 1510 when a golf ball contacts the ball striking face 114. The location and number of posts 1530A, 1530B within the club head 1510 may be changed without departing from the invention.

Figure 16:
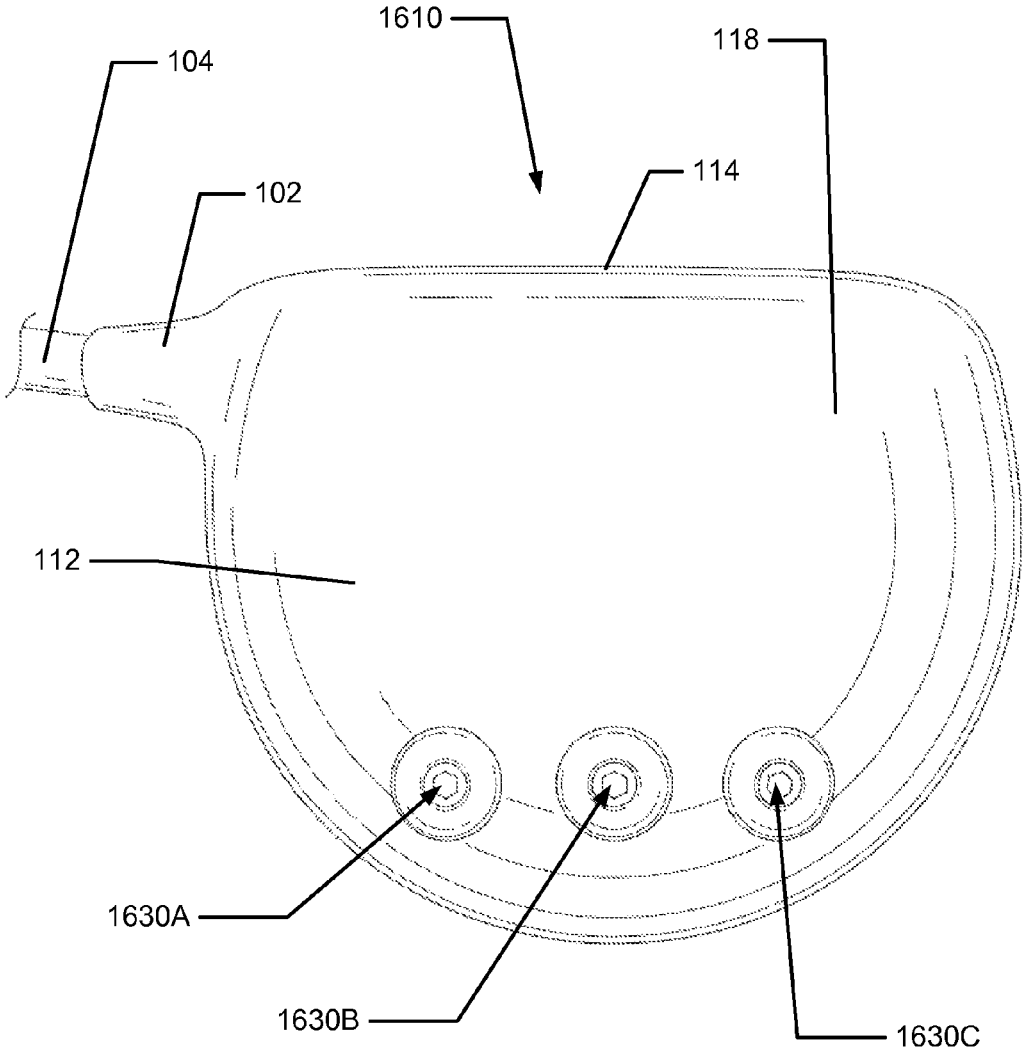
FIG. 16 illustrates a bottom view of another example golf club head according to this invention.

In another example according to this invention, as illustrated in FIG. 16, the club head 1610 may include multiple posts 1630A, 1630B, 1630C. In FIG. 3B, the club head 110 includes only one post 130. In the example club head 1610 illustrated in FIG. 16, each of the three posts 1630A, 1630B, 1630C are located towards the back of the club head 1610 opposite the side with the ball striking face 114. Additionally, in other examples according to this invention, any of the three posts 1630A, 1630B, 1630C may be located at various other locations throughout the club head 1610 without departing from this invention.

Additionally, a club head 1610 with a first post 1630A, a second post 1630B, and a third post 1630C as illustrated in FIG. 16 may have a different sound that emanates from the club head 1610 when a golf ball contacts the ball striking face 114 than a club head 110 with a single post 130 as illustrated in FIG. 3A. Therefore, the user may selectively chose a club head 1610 with either one post or multiple posts to control and alter the sound emanating from the club head 1610 when a golf ball contacts the ball striking face 114. The location and number of posts within the club head 1610 may be changed without departing from the invention.

Additional aspects of this disclosure relate to methods for producing golf clubs 100 and golf club heads 110 in accordance with examples of this disclosure. Such methods may include, for example, one or more of the following steps in any desired order and/or combinations: (a) providing a club head 110; (b) engaging a borehole insert 120 with a borehole 122 defined in the club head 110; and (c) engaging a post 130 with the borehole insert 120. The club head 110 may include a crown portion 116 and a sole portion 118. The sole portion 118 may include a borehole 122 defined therein that opens into an interior of the club head 110. The post 130 engages with the borehole insert 120 such that the post extends from the borehole insert 120 to an interior surface of the crown portion 116 of the club head 110. The post 130 may also be movable with respect to the borehole insert 120 so as to enable alteration of a sound produced by the club head 110 when a golf ball is struck by the club head 110. Additionally the post 130 may include external threads 138 and the borehole insert 120 may include internal threads 128. The post external threads 138 may engage the borehole insert 120 internal threads 128 when the post 130 is inserted into the club head body 112. Additionally, in accordance with this invention and as described in detail above, a variety of features of the club head 110, specifically the post 130, may be varied to alter a sound emanating from the club head body 112 when a golf ball contacts the ball striking face 114. Additionally, the method may include the steps of (d) engaging a golf club shaft 104 with the club head 110 at the hosel member 102; and/or (e) engaging a grip member 106 with the golf club shaft 104.

The club head 110 may be constructed in any suitable or desired manner and/or from any suitable or desired materials without departing from this disclosure, including from conventional materials and/or in conventional manners known and used in the art. The club head 110 and its various parts may be made by forging, casting, molding, and/or using other techniques and processes, including techniques and processes that are conventional and known in the art.

The various parts of the golf club 100 and the club head 110 may be engaged together in any desired manner. As some more specific examples, the various "engaging" steps described above may include one or more of: bonding using adhesives or cements; engaging using welding, brazing, soldering, or other fusing techniques; attachment using mechanical connectors (such as screws, bolts, nuts, or the like); and the like. If desired, in some more specific example structures according to this invention, the various parts of the club head 110 structure may be welded together.

Still additional aspects of the invention relate to methods for using golf clubs 100 and golf club heads 110 to control the sound and/or other aspects of the feel associated with a golf club 100 and golf club head 110 when it contacts a golf ball in use. For example, methods according to at least some examples of this invention may include the steps of: (a) providing a golf club 100 that includes a borehole 122 in the sole portion 118 and a borehole insert 120 that extends through the borehole 122 and into the club head 110; (b) engaging a post 130 with the borehole insert 120; and (c) adjusting a means for changing a sound (e.g., as described above) to thereby change the sound emanated by the club head 110 when the golf ball contacts the ball striking face 114. The means for changing the sound may allow a user to selectively change the sound emanated by the club head 110 when the golf ball contacts the ball striking face 114. Additionally, in accordance with this invention and as described in detail above, a variety of features of the club head 110, specifically the post 130, may be varied to alter a sound emanating from the club head body 112 when a golf ball contacts the ball striking face 114.

C. Conclusion

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

We claim:

1. A golf club head, comprising:

a club head body including a crown portion and a sole portion, wherein the sole portion includes a borehole therethrough, a borehole insert located at the sole portion of the club head body that extends through the borehole and into the club head body, the club head body further including a post that engages the borehole insert, the post having a first end and a second end opposite the first end, wherein when the post is inserted into the club head body, the first end is inserted through the borehole insert and the second end of the post releasably engages the borehole insert and is substantially flush with or countersunk into the sole portion, wherein the second end of the post includes external threads and the borehole insert includes internal threads that releasably engage the post external threads when the post is inserted into the club head body, and further wherein the club head body includes a crown support located at or adjacent to the crown portion of the club head body, wherein the post includes external threads located on the first end that engage internal threads located on the crown support when the post is inserted into the club head body;

a ball striking face engaged with or integrally formed as part of the club head body; and a hosel member engaged with or integrally formed with at least a portion of the club head.

2. A golf club head according to claim 1, further including a plate located between the crown support and the crown to spread out pressure exerted from the post over a larger surface area of the crown.

3. A golf club head according to claim 1, wherein the post includes a weight that is selectively moved up or down the length of the post.

4. A golf club head according to claim 3, wherein the post includes external threads and the weight includes internal threads, and the weight threadably engages the post to enable movement of the weight along a longitudinal length of the post between the first end and the second end of the post.

5. A golf club head according to claim 4, wherein a location of the weight along the post is selectively varied to alter a sound emanating from the club head body when a golf ball contacts the ball striking face.

6. A golf club head according to claim 3, wherein a shape of the weight is selectively varied to alter a sound emanating from the club head body when a golf ball contacts the ball striking face.

7. A golf club head according to claim 3, wherein a size of the weight is selectively varied to alter a sound emanating from the club head body when a golf ball contacts the ball striking face.

8. A golf club head according to claim 3, wherein a material of the weight is selectively varied to alter a sound emanating from the club head body when a golf ball contacts the ball striking face.

9. A golf club head according to claim 1, wherein the post is located in approximately the center of the club head body.

10. A golf club head according to claim 1, wherein the post is located towards a back of the club head, opposite the side of the ball striking face.

11. A golf club head according to claim 1, wherein the post has a round cross-section.

12. A golf club head according to claim 1, wherein the post is made of materials selected from the group of: titanium metal, a titanium alloy, aluminum, an aluminum alloy, or a polymeric material.

13. A golf club head according to claim 1, wherein the post includes a rubber tip on the first end that extends to and compresses against the crown portion of the club head body, wherein the extension and compression of the rubber tip against the crown portion of the club head body deadens a frequency that is emanated by the crown portion, thereby altering the sound emanating from the club head.

14. A golf club head, comprising:

a club head body including a crown portion and a sole portion, wherein the sole portion includes a threaded hole extending into an inside of the club head body and provided in the sole portion of the club head body, the club head body further including a post that directly engages the threaded hole provided in the sole of the club head body, the post having a first end and a second end opposite the first end, wherein when the post is inserted into the club head body, the first end is inserted through the threaded hole and the second end of the post releasably engages the threaded hole and is substantially flush with or countersunk into the sole portion, wherein the second end of the post includes external threads and the threaded hole includes internal threads that releasably engage the post external threads when the post is inserted into the club head body, and further wherein the club head body includes a crown support located at or adjacent to the crown portion of the club head body, wherein the post includes external threads located on the first end that engage internal threads located on the crown support when the post is inserted into the club head body;

a plate located between the crown support and the crown to spread out pressure exerted from the post over a larger surface area of the crown;

a ball striking face engaged with or integrally formed as part of the club head body; and a hosel member engaged with or integrally formed with at least a portion of the club head.

15. A golf club head according to claim 14, wherein the post includes a weight that is selectively moved up or down the length of the post.

16. A golf club head according to claim 15, wherein the post includes external threads and the weight includes internal threads, and the weight threadably engages the post to enable movement of the weight along a longitudinal length of the post between the first end and the second end of the post.

17. A golf club head according to claim 16, wherein a location of the weight along the post is selectively varied to alter a sound emanating from the club head body when a golf ball contacts the ball striking face.

18. A golf club head according to claim 15, wherein a shape of the weight is selectively varied to alter a sound emanating from the club head body when a golf ball contacts the ball striking face.

19. A golf club head according to claim 15, wherein a size of the weight is selectively varied to alter a sound emanating from the club head body when a golf ball contacts the ball striking face.

20. A golf club head according to claim 15, wherein a material of the weight is selectively varied to alter a sound emanating from the club head body when a golf ball contacts the ball striking face.

21. A golf club head according to claim 13, wherein the post is located in approximately the center of the club head body.

22. A golf club head according to claim 13, wherein the post is located towards a back of the club head, opposite the side of the ball striking face.

23. A golf club head according to claim 13, wherein the post has a round cross-section.

24. A golf club head according to claim 13, wherein the post is made of materials selected from the group of: titanium metal, a titanium alloy, aluminum, an aluminum alloy, or a polymeric material.

25. A golf club head according to claim 13, wherein the post includes a rubber tip on the first end that extends to and compresses against the crown portion of the club head body, wherein the extension and compression of the rubber tip against the crown portion of the club head body deadens a frequency that is emanated by the crown portion, thereby altering the sound emanating from the club head.

* * * * *